US009799995B1

(12) United States Patent
Zhou et al.

(10) Patent No.: US 9,799,995 B1
(45) Date of Patent: Oct. 24, 2017

(54) DUAL UNIBODY USB CONNECTOR

(71) Applicant: Apple Inc., Cupertino, CA (US)

(72) Inventors: Rui Zhou, Mountain View, CA (US); Mahmoud R. Amini, Sunnyvale, CA (US); Daren L. Rimando, Cupertino, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 15/274,241

(22) Filed: Sep. 23, 2016

(51) Int. Cl.

| | |
|---|---|
| ***H01R 13/659*** | (2011.01) |
| ***H01R 24/60*** | (2011.01) |
| ***H01R 13/629*** | (2006.01) |
| *H01R 107/00* | (2006.01) |

(52) U.S. Cl.
CPC ..... *H01R 13/659* (2013.01); *H01R 13/629* (2013.01); *H01R 24/60* (2013.01); *H01R 2107/00* (2013.01)

(58) Field of Classification Search
CPC H01R 13/659; H01R 13/658; H01R 13/6585; H01R 13/629; H01R 24/60
USPC ..... 439/607.25, 607.27, 540.1, 541.5, 76.1
See application file for complete search history.

(56) References Cited

U.S. PATENT DOCUMENTS

| | | | | |
|---|---|---|---|---|
| 6,193,554 | B1 * | 2/2001 | Wu | H01R 24/62 439/607.25 |
| 8,968,031 | B2 * | 3/2015 | Simmel | H01R 13/659 439/108 |
| 2014/0364008 | A1 * | 12/2014 | Simmel | H01R 13/64 439/607.23 |

* cited by examiner

*Primary Examiner* — Harshad Patel
(74) *Attorney, Agent, or Firm* — Kilpatrick Townsend & Stockton, LLP

(57) ABSTRACT

Combined connector receptacles, examples of which provide an upper housing having openings for tongues on each of two lower housings to simplify alignment of the tongues to a device enclosure, and inner shields around the lower housings and an outer shield around the upper housing and lower housings to provide isolation.

21 Claims, 20 Drawing Sheets

DUAL UNIBODY USB CONNECTOR

BACKGROUND

Power and data may be provided from one electronic device to another over cables that may include one or more wire conductors, fiber optic cables, or other conductors. Connector inserts may be located at each end of these cables and may be inserted into connector receptacles in the communicating or power transferring electronic devices.

These connector receptacles may be located in openings in enclosures of electronic devices. Some devices may contain several such connector receptacles, some of which may be of the same type while others may be of different types. To save space and simplify manufacturing, in some circumstances it may be desirable to combine more than one connector receptacle into a single unit. Such a unit may be referred to as a combined connector receptacle.

Various problems may arise when connector receptacles are gathered into a combined connector receptacle. For example, it may be difficult to align multiple connector receptacles to openings in an enclosure of an electronic device. This may be true where various surfaces of the combined connector receptacle are oblique to each other.

Also, contacts in each connector receptacle may convey high-speed signals along with power supplies and other signals. The high-speed signals may have relatively fast edges having high-frequency signal components that may generate electromagnetic interference (EMI.) This EMI may couple onto other high-speed signal contacts, as well as power contacts and contacts for other signals, in the same or other connector receptacles in the combined connector receptacle. This coupling may in turn corrupt and degrade signals, that is, lower the signal quality or signal integrity, in the same or other connector receptacles. Accordingly, it may be desirable to provide isolation between connector receptacles in a combined connector receptacle. Further, it may be desirable to provide isolation among contacts in an individual connector receptacle in a combined connector receptacle.

Thus, what is needed are combined connector receptacles that may be aligned to openings in a device enclosure, may provide isolation between individual connector receptacles, and may provide isolation among contacts in an individual connector receptacle in a combined connector receptacle.

SUMMARY

Accordingly, embodiments of the present invention may provide combined connector receptacles that may be aligned to openings in a device enclosure, may provide isolation between individual connector receptacles, and may provide isolation among contacts in an individual connector receptacle in a combined connector receptacle.

An illustrated embodiment of the present invention may provide a combined connector receptacle that may be aligned to openings in a device enclosure by providing a combined connector receptacle having a upper housing formed as a single piece and having openings for tongues attached to a number of lower housing assemblies. Since the openings are each formed in a single upper housing, their relative spacing may be well controlled.

These and other embodiments of the present invention may provide a combined connector receptacle that may be aligned to openings in a device enclosure by providing an alignment pin that is located in a passage though the upper housing. The alignment pin may have a first end extending from a top of the upper housing to fit in a recess or hole in a device enclosure. The alignment pin may have a second end extending from a bottom of the upper housing to fit in an opening, hole, or recess in a printed circuit board or other appropriate substrate.

These and other embodiments of the present invention may provide a combined connector receptacle that may be used to provide multiple connector receptacles in a single unit where a surface of an enclosure for an electronic device is not orthogonal with, or parallel to, a printed circuit board or other appropriate substrate in the electronic device. For example, a surface of a combined connector receptacle may be oblique to other surfaces of the combined connector receptacle. Such a combined connector receptacle may be mounted on a printed circuit board and provide connector receptacles at openings in a device enclosure surface that is oblique to the printed circuit board. In these and other embodiments of the present invention, a combined connector receptacle may include a number of lower housing assemblies having tongues and an upper housing having openings for each of the tongues. The upper housing may have an average thickness over one of the lower housing assemblies that is greater than its average thickness over another of the lower housing assemblies. The lower housing assemblies may be wedged shaped along their lengths to provide a tilted angle to the tongues relative to a bottom of the combined connector receptacle.

An illustrated embodiment of the present invention may provide a combined connector receptacle that may provide isolation between its individual connector receptacles. This isolation may be achieved in part by proving separate inner shields over each of the lower housing assemblies. The inner shields may have each have lateral tabs that may be soldered or spot or laser welded together.

An illustrated embodiment of the present invention may provide a combined connector receptacle that may provide isolation between contacts in an individual connector receptacle. This isolation may be achieved in part by proving a central ground plane in each of the tongues of the lower housing assemblies. The central ground plane may isolate contacts on a top side of a tongue from contacts on a bottom side of the tongue.

These and other embodiments of the present invention may provide lower housing assemblies having a plurality of contacts. The plurality of contacts may include a plurality of signal contacts and a plurality of power contacts. In a first plane, the plurality of power contacts may each be stamped to include an acute angle, while the plurality of signal contacts are not stamped to form an acute angle. The plurality of signal contacts may include adjacent first and second signal contacts. The first and second signal contacts may be adjacent to a power contact and a ground contact. These power supply or ground contacts adjacent to the high-speed differential pair signal contacts may shield and isolate the high-speed differential pair signal contacts. The power contacts may include the acute angle such that spacing between the ground contact and the first signal contact at least approximately matches the spacing between the power contact and the second signal contact. This matched spacing may improve shielding and isolation between pairs of signal contacts and other contacts in the same or different connector receptacles. In these and other embodiments of the present invention, ground or power, or both, may include an acute angle. That is, they may be routed to include an acute angle. In these and other embodiments of the present invention, a plurality of contacts on one side of a connector receptacle tongue may be formed of a single sheet of conductive material, such as a single sheet of stainless steel or sheet metal.

In these and other embodiments of the present invention, the power supply and signal contacts may include through-hole contacting portions. These through-hole contacting portions may fit in openings in a printed circuit board or other appropriate substrate to form electrical connections with traces in the printed circuit board or other appropriate substrate. These through-hole contacting portions may also provide mechanical stability for the combined connector receptacle. In other embodiments of the present invention, some or all of the contacts may terminate in surface-mount contacting portions.

These and other embodiments of the present invention may provide a combined connector receptacle having improved isolation among connector receptacles and among contacts in a connector receptacle by providing multiple ground paths. A shield of a connector insert inserted into a connector receptacle may connect to an EMI contact. The EMI contact may be soldered or spot or laser welded to an outer shield over the combined connector receptacle. The outer shield may include tabs that may fit in openings in a printed circuit board or other substrate, thereby forming ground connections.

The connector insert shield may also connect to a ground pad on the tongue via ground contacts of the connector insert. The tongue ground pad may connect to inner ground shields, which may be over lower housing assemblies of the combined connector receptacle. The inner ground shields may include tabs that may fit in openings in a printed circuit board or other substrate, thereby forming ground connections. The inner ground shield may be soldered or spot or laser welded to the outer shield, which again may include tabs to fit in openings in a printed circuit board. The ground pads may be part of a metallic ground frame that may further contact a central ground plane in the tongue of the connector receptacle. The central ground plane may include ground pins that may fit in openings in a printed circuit board or other substrate, thereby forming another ground connection. The ground frame may also be connected to other ground contacts that that may fit in openings in a printed circuit board or other substrate, thereby forming ground connections.

The connector insert shield may also connect to ground contacts on the tongue via side ground contacts of the connector insert. The ground contacts on the tongue may be part of the ground frame, which may have the ground pathways described above.

The ground contacts and ground frame may be metallic. For example, they may be formed by metal-injection molding. This may improve the wear performance, durability, and reliability of the receptacles in the combined connector receptacle.

While embodiments of the present invention may be useful in combined connector receptacles, these and other embodiments of the present invention may be used in single connector receptacle structures as well.

In various embodiments of the present invention, contacts, central ground planes, tongue frames, shields, EMI contacts, and other conductive portions of a combined connector receptacle may be formed by stamping, metal-injection molding, machining, micro-machining, 3-D printing, or other manufacturing process. The conductive portions may be formed of stainless steel, steel, copper, copper titanium, phosphor bronze, or other material or combination of materials. They may be plated or coated with nickel, gold, or other material. The nonconductive portions, such as the housings, tongue insert portions, and other structures may be formed using injection or other molding, 3-D printing, machining, or other manufacturing process. The nonconductive portions may be formed of silicon or silicone, rubber, hard rubber, plastic, nylon, liquid-crystal polymers (LCPs), ceramics, or other nonconductive material or combination of materials. The printed circuit boards used may be formed of FR-4 or other material. Printed circuit boards may be replaced by other substrates, such as flexible circuit boards, in many embodiments of the present invention.

Embodiments of the present invention may provide combined connector receptacles that may be located in, and may connect to, various types of devices, such as portable computing devices, tablet computers, desktop computers, laptops, all-in-one computers, wearable computing devices, cell phones, smart phones, media phones, storage devices, portable media players, navigation systems, monitors, power supplies, video delivery systems, adapters, remote control devices, chargers, and other devices. These combined connector receptacles may provide pathways for signals that are compliant with various standards such as one of the Universal Serial Bus (USB) standards including USB Type-C, High-Definition Multimedia Interface® (HDMI), Digital Visual Interface (DVI), Ethernet, DisplayPort, Thunderbolt™, Lightning™ Joint Test Action Group (JTAG), test-access-port (TAP), Directed Automated Random Testing (DART), universal asynchronous receiver/transmitters (UARTs), clock signals, power signals, and other types of standard, non-standard, and proprietary interfaces and combinations thereof that have been developed, are being developed, or will be developed in the future. Other embodiments of the present invention may provide combined connector receptacles that may be used to provide a reduced set of functions for one or more of these standards. In various embodiments of the present invention, these interconnect paths provided by these connector inserts and connector receptacles may be used to convey power, ground, signals, test points, and other voltage, current, data, or other information.

Various embodiments of the present invention may incorporate one or more of these and the other features described herein. A better understanding of the nature and advantages of the present invention may be gained by reference to the following detailed description and the accompanying drawings.

DESCRIPTION OF ILLUSTRATIVE EMBODIMENTS

Figure 1:
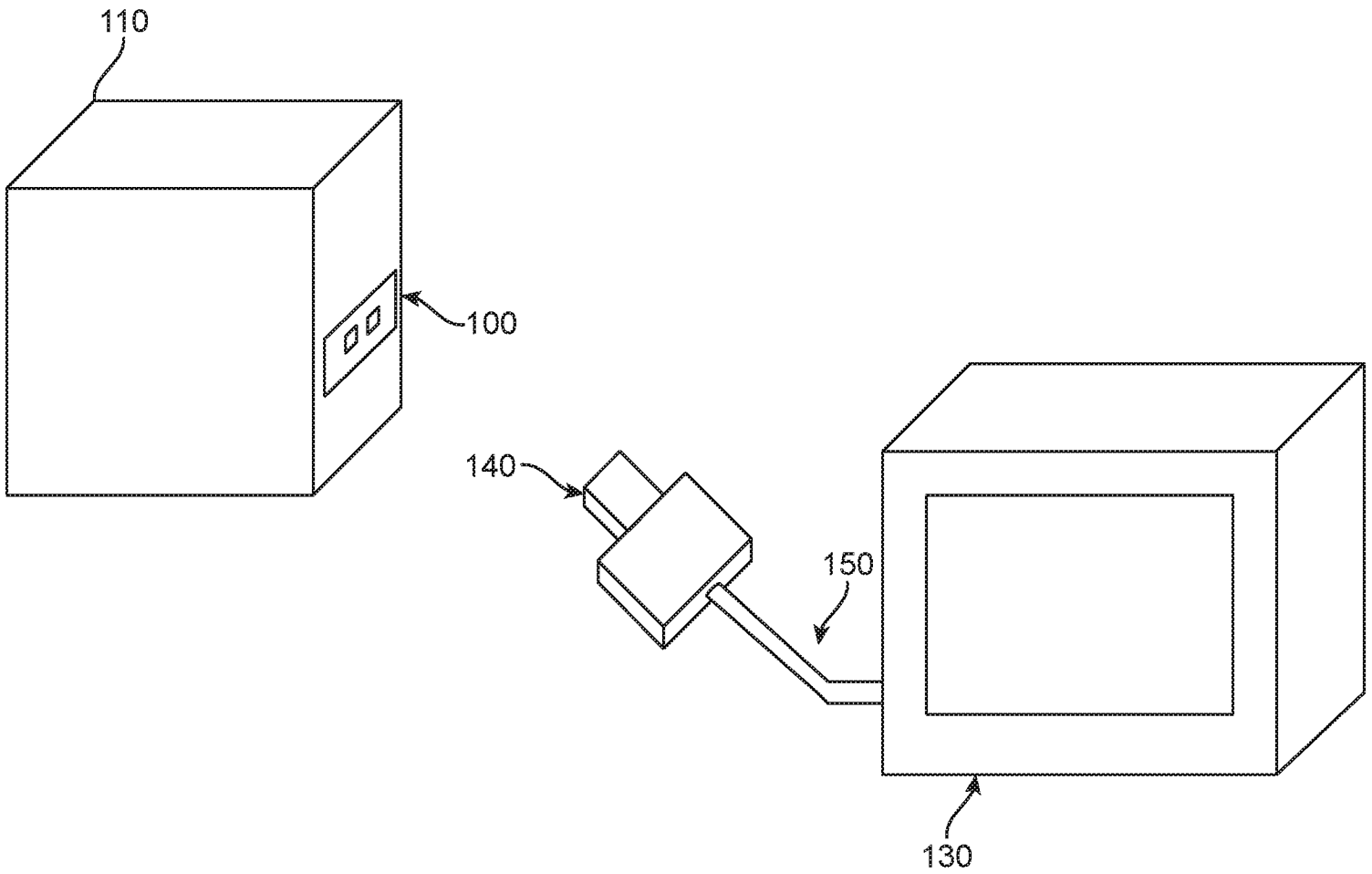
FIG. 1 illustrates an electronic system that may be improved by the incorporation of embodiments of the present invention.

FIG. 1 illustrates an electronic system that may be improved by the incorporation of embodiments of the present invention. This figure, as with the other included figures, is shown for illustrative purposes and does not limit either the possible embodiments of the present invention or the claims.

This electronic system includes computer 110 and electronic device 130. Computer 110 may communicate with electronic device 130 through cable 150. Specifically, connector insert 140 may be inserted into one of the group of connector receptacles in combined connector receptacle 100 on computer 110, and computer 110 may communicate with an electronic device 130 by sending and receiving signals (and perhaps power), through conductors in cable 150.

Again, it may be desirable for computer 110 to communicate with several devices. These devices may be able to communicate with computer 110 using the same interface standard. Accordingly, several connector receptacles of the same type may be provided by combined connector receptacle 100, though in other embodiments of the present invention, several connector receptacles of different types may be provided by combined connector receptacle 100.

It may also be difficult to align openings of the connector receptacles of combined connector receptacle 100 to corresponding openings in a device enclosure of computer 110. This is particularly true if a surface of the device enclosure for computer 110 is slanted relative to a printed circuit board supporting combined connector receptacle 100. Accordingly, an embodiment of the present invention may provide a combined connector receptacle having an upper housing formed as a single unit. An example is shown in the following figures.

Figure 2:
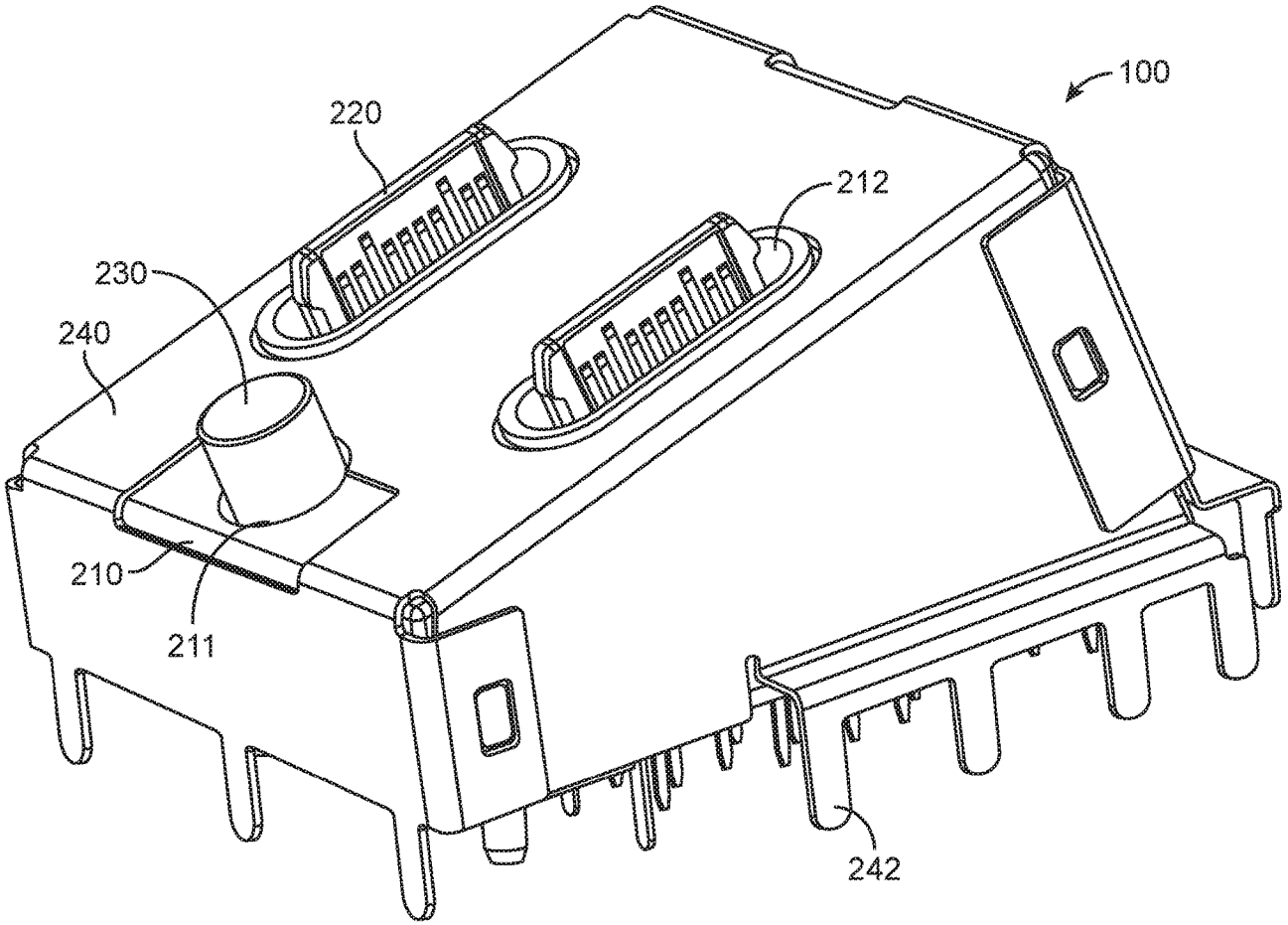
FIG. 2 illustrates a front view of a combined connector receptacle according to an embodiment of the present invention.

FIG. 2 illustrates a front view of a combined connector receptacle according to an embodiment of the present invention. Combined connector receptacle 100 may include upper housing 210 having top, front, back, and sides at least partially covered by shield 240. Shield 240 may include tabs 242. Tabs 242 may be inserted into corresponding openings in a printed circuit board or other appropriate substrate to form ground connections. Upper housing 210 may include openings 212 to allow passage of tongues 220 from lower housing assemblies (not shown.)

Alignment pin 230 may be located in passage 211 of housing 210. Alignment pin 230 may include a first end extending above housing 210. The first end may be inserted into a hole or recess in a device enclosure. Alignment pin 230 may further include a second end (not shown) emerging from a bottom of housing 210. This second end of alignment pin 230 may be inserted into an opening, hole, or recess in a printed circuit board. In this way, the combined connector receptacle 100 may be aligned to a device enclosure and a printed circuit board. In this specific embodiment, alignment pin 230 may be formed separate from housing 210. Alignment pin may be formed of metal or other material. In other embodiments of the present invention, some or all of alignment pin 230 may be formed as part of housing 210.

Figure 3:
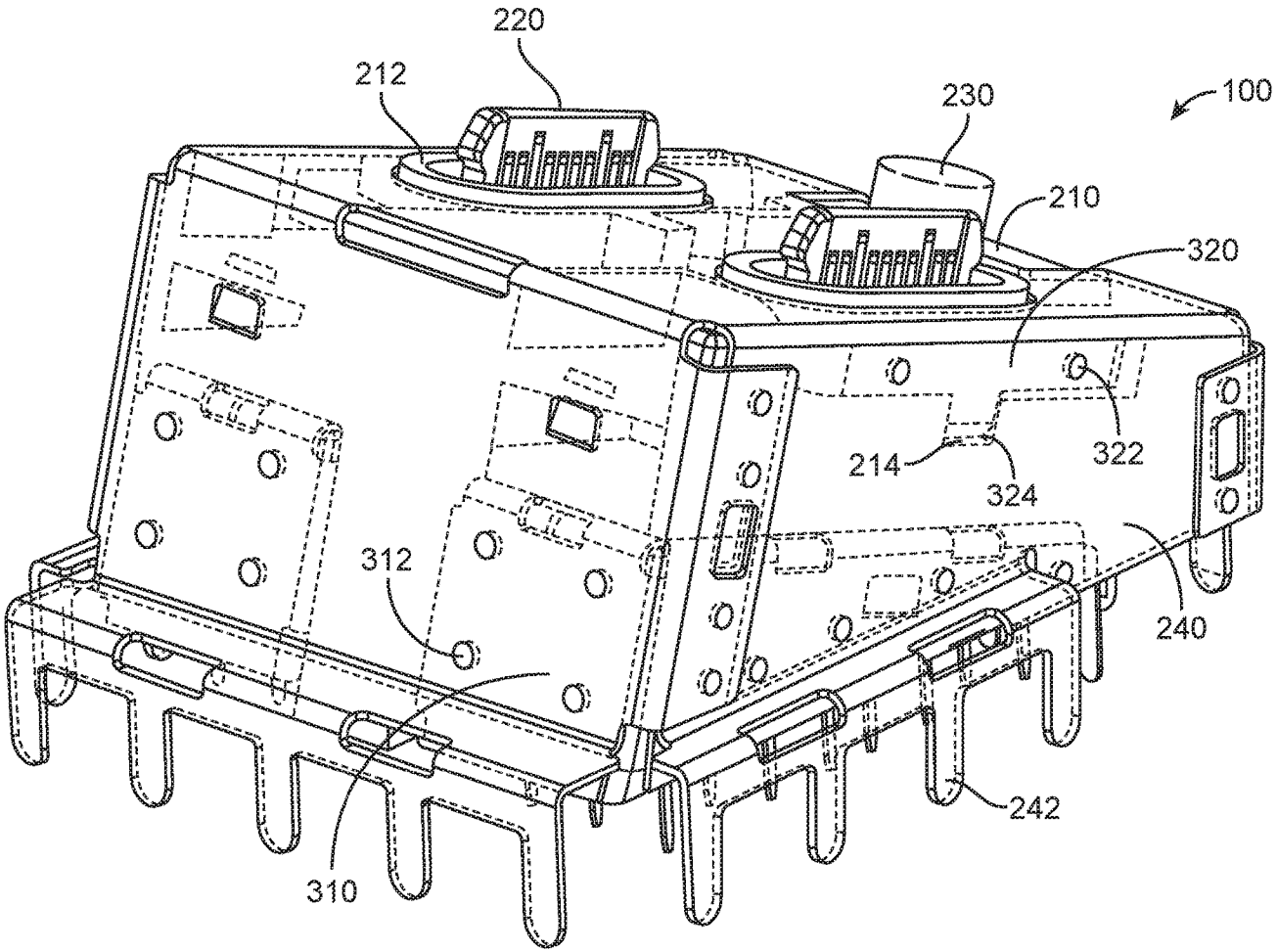
FIG. 3 illustrates a back view of a combined connector receptacle according to an embodiment of the present invention.

FIG. 3 illustrates a back view of a combined connector receptacle according to an embodiment of the present invention. Again, combined connector receptacle 100 may include upper housing 210. Upper housing 210 may be at least partially covered by shield 240. In this example, outer shield 240 may cover a top, back, front, and sides of upper housing 210. Outer shield 240 may include tabs 242, which may be inserted into openings in a printed circuit board or other appropriate substrate to form connections to ground.

Combined connector receptacle 100 may further include tongues 220, which may be located in openings 212 in housing 210. Tongues 220 may be part of lower housing assemblies (not shown.) The lower housing assemblies may be at least partially covered by inner shield 310. Inner shield 310 may be soldered or spot or laser welded to the outer shield 240 at locations 312.

The connector receptacles formed by tongues 220 and openings 212 of housing 210 may include ground contacts to electrically contact outside shield of a connector insert when the connector insert is mated with the connector receptacle. Accordingly, the connector receptacles may include EMI contacts 320. EMI contacts 320 may be soldered or spot or laser welded to outer shield 240 at points 322. EMI contacts 320 may include tabs 324, which may be inserted into slots 214 in upper housing 210 to secure EMI contacts 320 in place, which may be of particular use during assembly. Alignment pin 230 may also be included.

In various embodiments of the present invention, a surface of a device enclosure may be angled relative to a printed circuit board on which combined connector receptacle 100 may reside. In this example, a slight angle between tongues 220 may exist. This angle may be achieved by providing an upper housing having a greater average thickness above one of the lower housing assemblies 410 as compared to the other. In this specific example, facing the back of combined connector receptacle 100, the upper housing 210 has increased thickness to the left side. Also in this example, a sharp angle in the direction if a length of tongue 220 may exist. This angle may be achieved by providing lower housing assemblies 410 with a generally wedge shape.

In this example, combined connector receptacle 100 may include two lower housing assemblies for USB Type-C receptacles. In other embodiments of the present invention, combined connector receptacle 100 may include other numbers of lower housing assemblies and the lower housing assemblies may be of one or more different types. These various types of lower housing assemblies may utilize various types of openings 212 in housing 210.

Figure 4:
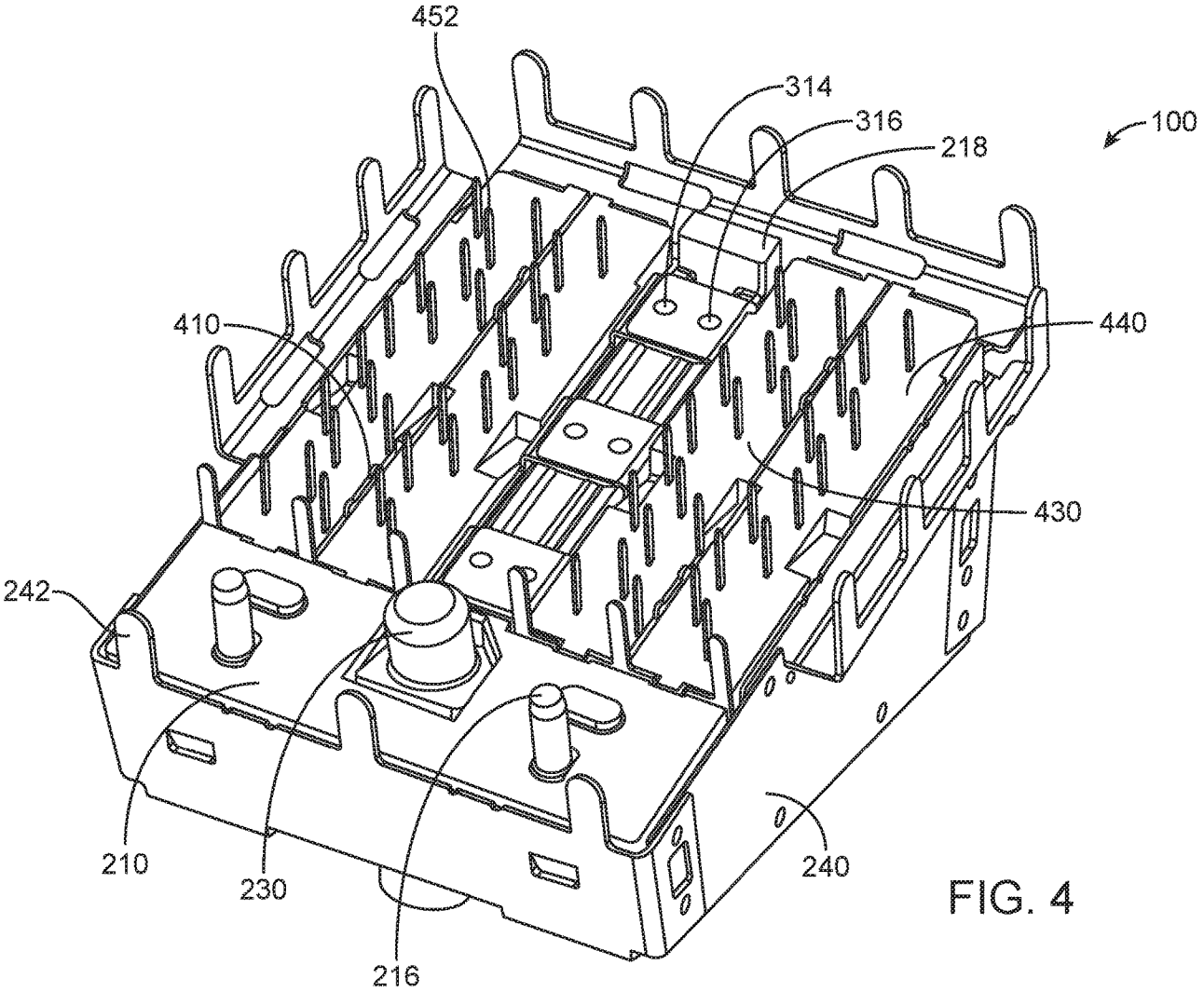
FIG. 4 illustrates an underside of a combined connector receptacle according to an embodiment of the present invention.

FIG. 4 illustrates an underside of a combined connector receptacle according to an embodiment of the present invention. In this example, lower housing assemblies 410 may be attached to an underside of upper housing 210. Lower housing assemblies 410 may include lower housing portions 430 and 440. Each lower housing portion 430 and 440 may be formed around a plurality of contacts (shown below) having through-hole contact portions 452. While through-hole contact portions 452 are shown in these examples, some of all of the contacts may instead terminate in surface-mount contacting portions.

Upper housing 210 may include posts 216 and tab 218. These structures may fit in corresponding openings in a printed circuit board (not shown) for alignment and mechanical stability purposes. A second end of alignment pin 230 may emerge from an underside of housing 210. The second end of alignment pin 230 may be inserted into an opening, hole, or recess in a printed circuit board or other appropriate substrate (not shown) for alignment and mechanical stability.

As shown above in FIG. 3, lower housing assemblies 410 may be at least partially covered by shield 310. Shields 310 may include tabs 314 which may overlap with each other in the region between lower housing assemblies 410. Tabs 314 of shields 310 may be soldered or spot or laser welded to each other at points 316.

As before, shield 240 may at least partially cover upper housing 210 and lower housing assemblies 410. Shields 240 may include tabs 242. Tabs 242 may be inserted into openings of a printed circuit board or other appropriate substrate for grounding purposes.

In various embodiments of the present invention, combined connector receptacle 100 may be arranged to support the routing of traces in a printed circuit board. For example, lower housing assemblies 410 may be separated to allow routing between them. Also, some tabs 242 may be spaced from lower housing assemblies 410 to provide space for routing.

In various embodiments of the present invention, an upper housing 210 may provide openings 212 for various numbers of tongues 220 connected to lower housing assemblies 410. In the illustrated examples, two lower housing assemblies 410 may be included, though in other embodiments of the present invention other numbers, such as three, four, five, six, or more than six lower housing assemblies 410 may be attached under an upper housing, such as upper housing 210. An example showing a pair of lower housing assemblies 410 is shown in the following figure.

Figure 5:
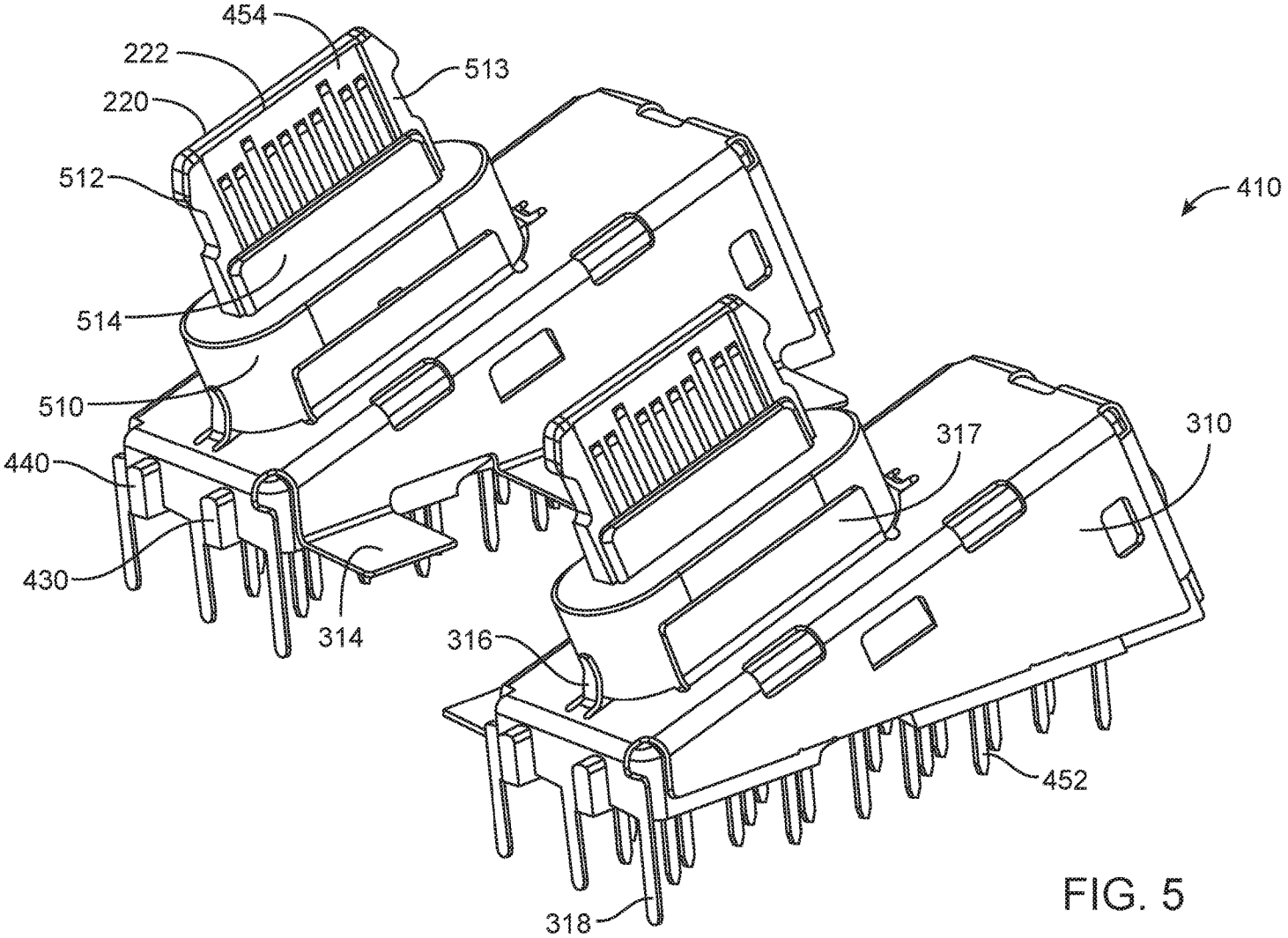
FIG. 5 illustrates a pair of lower housing assemblies according to an embodiment of the present invention.

FIG. 5 illustrates a pair of lower housing assemblies according to an embodiment of the present invention. Lower housing assemblies 410 may include tongues 220. Tongues 220 may support a number of contact portions 454 of contacts (shown below in further detail.)

Tongue 220 may be supported by tongue frame 510. Tongue frame 510 may include ground pads 514 and side ground contacts 512. Ground pads 514 may be located behind contacting portions 454 of the contacts. Contacting portions 454 of the contacts may be located between a front edge of tongue 220 and ground pads 514. Side ground contacts 512 may include notches 513. Notches 513 may engage contacting portions of side ground contacts in a connector insert when the connector insert is mated with a connector receptacle. Tongue insert portion 222 may be formed between side ground contacts 512 of tongue frame 510.

In various embodiments of the present invention, tongue frame 510 may be formed of a conductive material or metal by injection molding, forging, printing, or by other appropriate techniques. Forming tongue frame 510 from metal, for example by metal injection molding, may improve wear performance, reliability, and durability of combined connector receptacle 100. Tongue insert portion 222 may be formed of a nonconductive material, such as plastic, by injection molding or other appropriate techniques. This material may be a UL 94 V-0 grade plastic or other type of plastic or other material having a high flow rate for better formation of the features of tongue insert portion 222, which are described further in FIG. 10. The material may also be selected to have a reduced glass fill content.

Lower housing assemblies 410 may include lower housing portions 440 and 430. Lower housing portions 440 and 430 may provide mechanical support for contacts having contacting portions 454 and through-hole contacting portions 452. Shield 310 may cover portions of lower housing portions 430 and 440. For example, shields 310 may at least partially cover tops, sides, front and backs of lower housing portions 430 and 440. Shield 310 may include folded portions 316 and 317. Folded portions 316 and 317 may form electrical connections with tongue frame 510. Folded portions 316 and 317 may be soldered or spot or laser welded to tongue frame 510. Shield 310 may further include tabs 318. Tabs 318 may be inserted into corresponding openings in a printed circuit board to form ground connections. Shields 310 may further include tabs 314. Tabs 314 may be soldered or spot or laser welded to each other. In various embodiments of the present invention, lower housing assemblies 410, with the exception of shields 310, may be identical. Shields 310 may be mirror images of each other.

Figure 6:
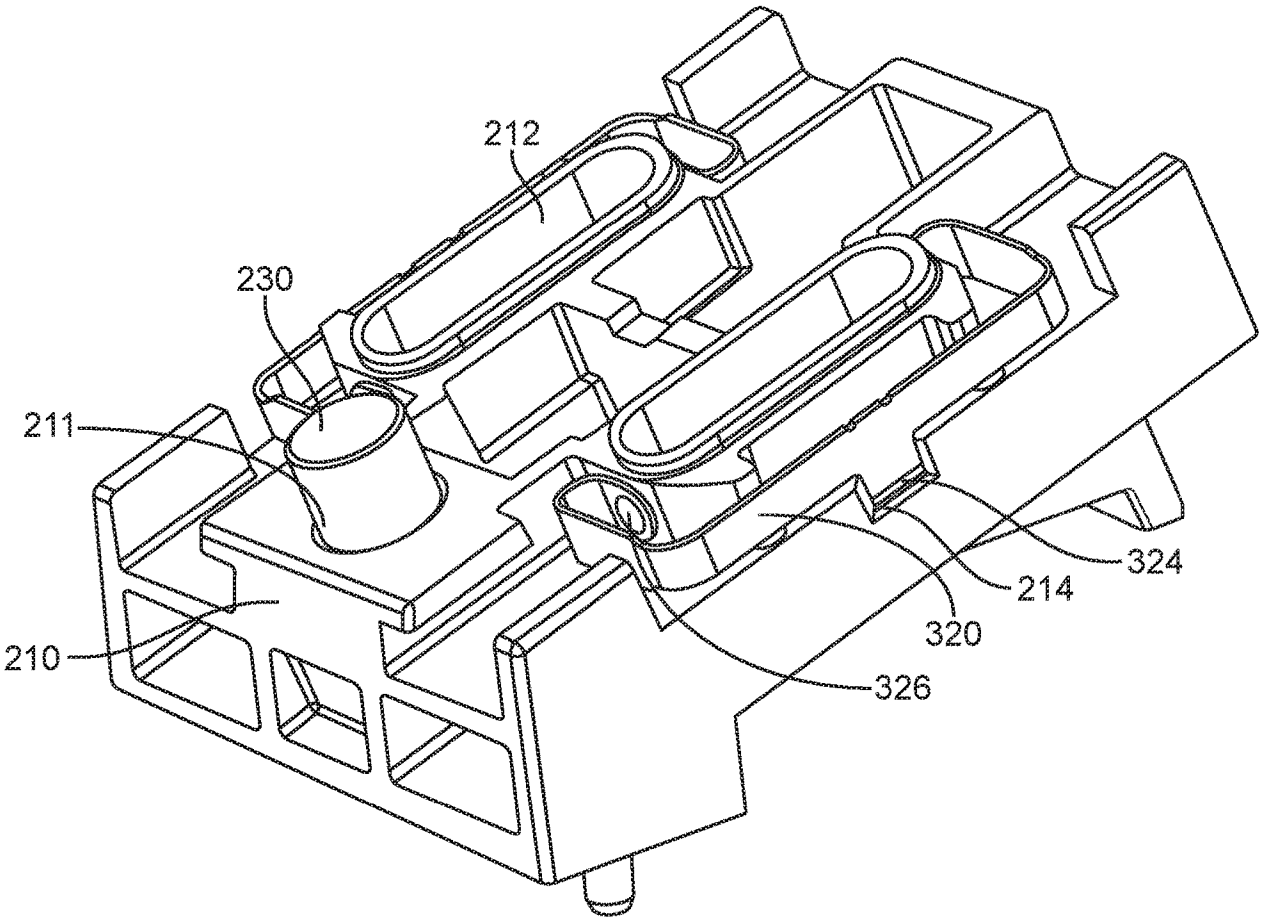
FIGS. 6-8 illustrate an assembly of a combined connector receptacle according to an embodiment of the present invention.
Figure 7:
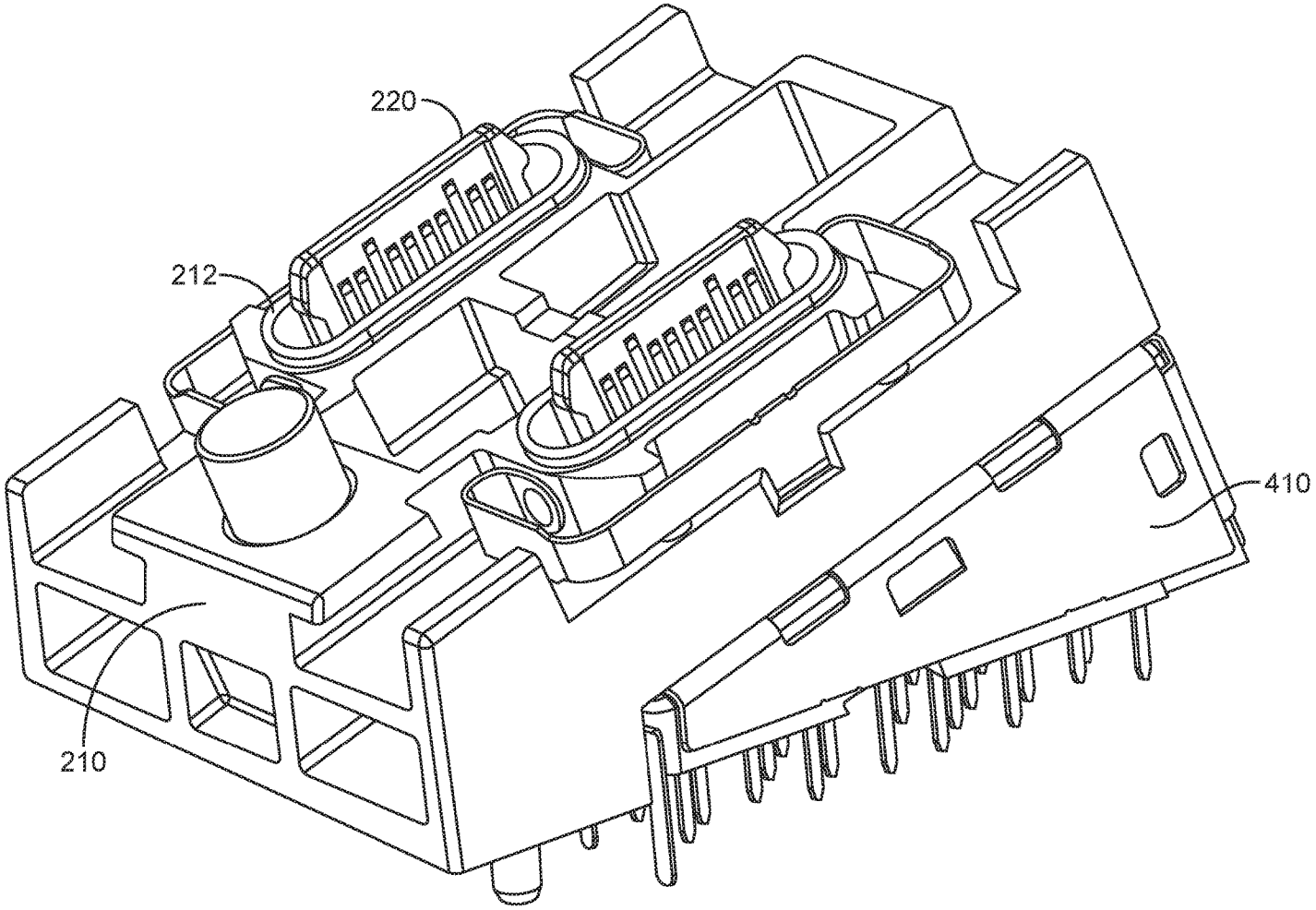
Figure 8:
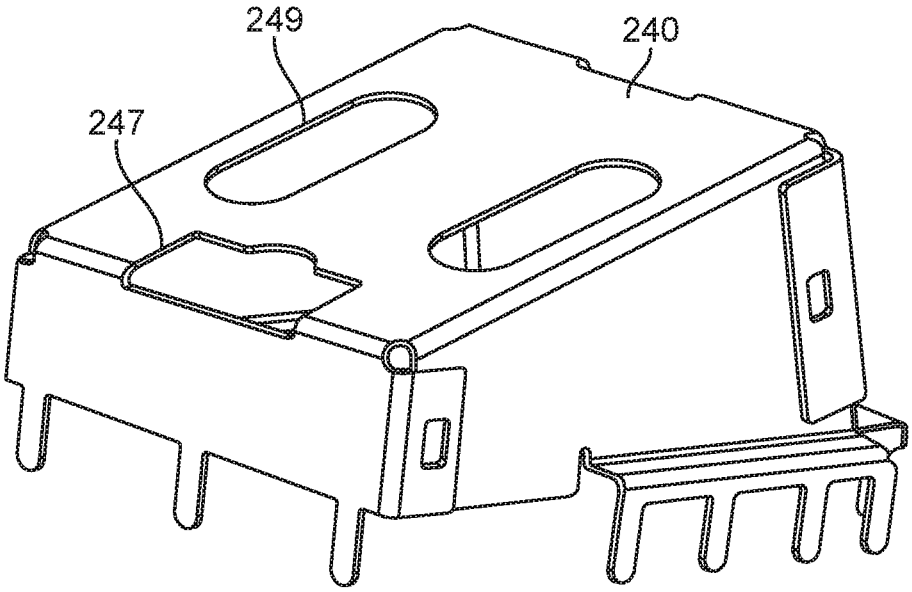
Figure 18:
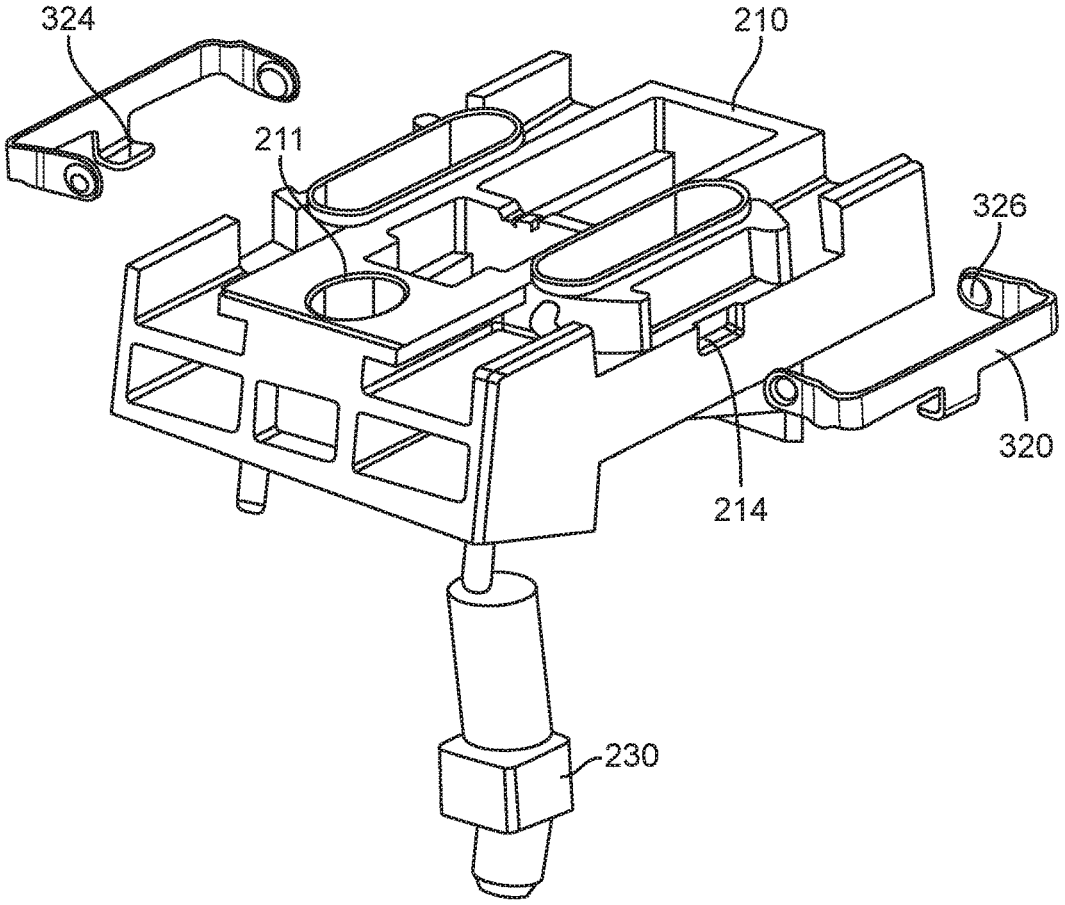

FIGS. 6-8 illustrate an assembly of a combined connector receptacle according to an embodiment of the present invention. In FIG. 6, alignment pin 230 may be inserted into passage 211 of upper housing 210. Tab 324 of EMI contacts 320 may be inserted into slot 214 in upper housing 210. In various embodiments of the present invention, EMI contacts 320 may include various contacting portions 326. In this example, contact portion 326 may be folded back onto itself as shown. In other embodiments of the present invention, contact portions 326 may simply reside at an end of EMI contact 320. An example is shown in FIG. 18. In FIG. 7, a number of lower housing assemblies 410 may be attached to an underside of upper housing 210. Tongues 220 of lower housing assemblies 410 may emerge through openings 212 in upper housing 210. In FIG. 8, shield 240 may be provided. Shield 240 may include openings 249, which may align to openings 212 in upper housing 210 as shown in FIG. 7. Shield 240 may further include opening 247 to allow passage of alignment pin 230 as shown in FIG. 6. Once shield 240 is in place, the combined connector receptacle 100 of FIG. 1 may be complete.

Figure 9:
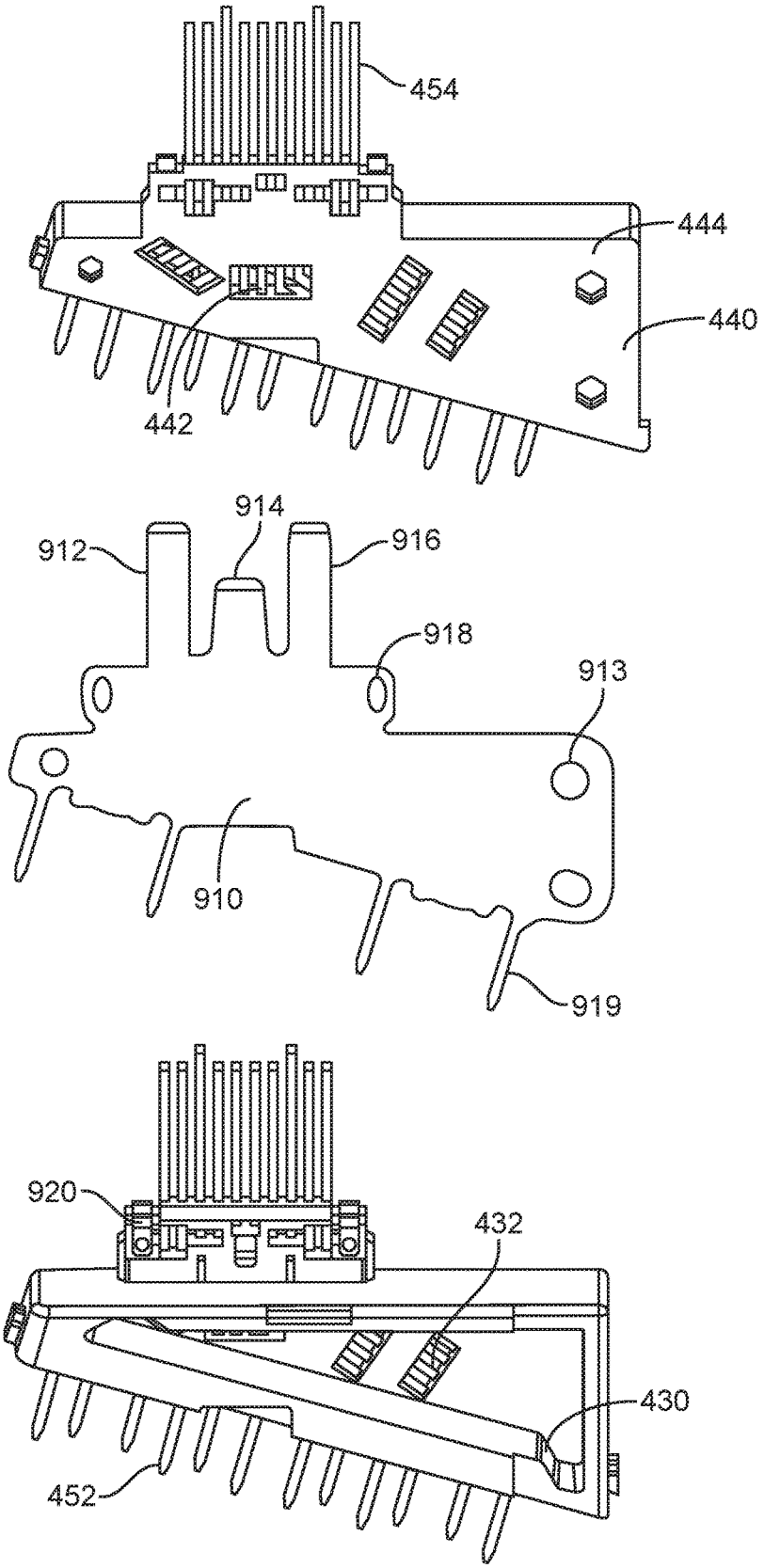
FIGS. 9-12 illustrates the assembly of a lower housing assembly according to an embodiment of the present invention.

FIGS. 9-12 illustrates the assembly of a lower housing assembly according to an embodiment of the present invention. In FIG. 9, lower housing portions 430 and 440 may be attached with a central ground plane 910 between them. For example, posts (not shown) on lower housing portion 430 may fit through openings 913 in central ground plane 910 and into holes or recesses 444 in lower housing portion 440. Lower housing portions 430 and 440 may be insert molded around contacts having contact portions 454 and through-hole contacting portions 452.

Lower housing portions 430 and 440 may include openings 432 and 442. These openings 432 and 442 may reduce a capacitance seen by the contacts, thereby increasing their impedance over frequency. Central ground plane 910 may include protrusions 912, 914, and 916, which may fit into slots in a molded portion of tongue 220, as shown below. Central ground plane 910 may include through-hole contacting portions 919.

In various embodiments of the present invention, various structures may be used to improve the grounding in these lower housing assemblies. In this example, central ground plane 910 may include side loops 918. During assembly, side loops 918 may be compressed against an inside of tongue frame 510, as shown below. Also, lower housing portions 430 and 440 may include ground contacts 920. Ground contacts 920 may be folded back onto themselves such that they may contact the inside surface of tongue frame 510 when tongue frame 510 is mated with the lower housing portions 430 and 440. An example of this mating is shown in the following figure.

Figure 10:
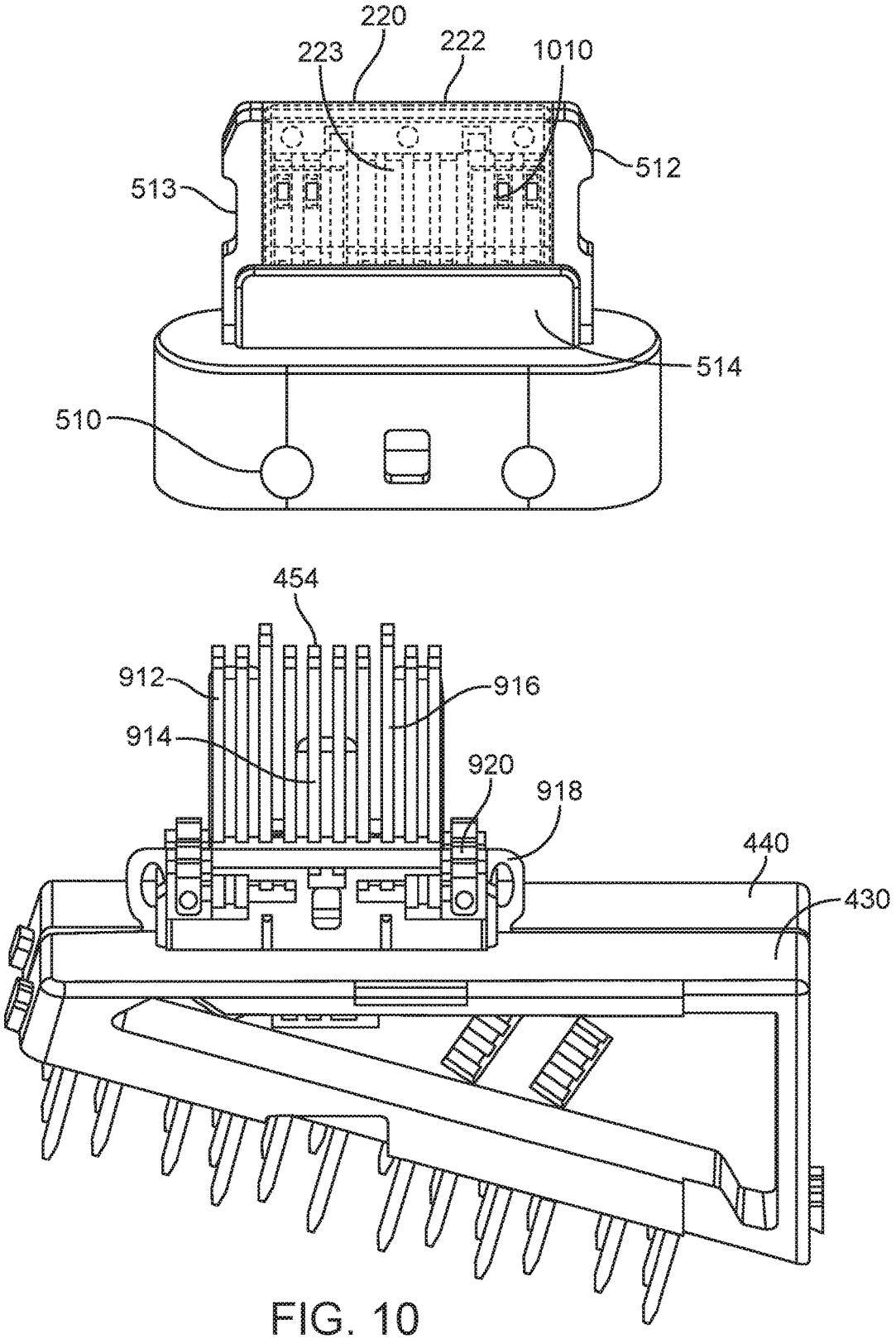

In FIG. 10, tongue frame 510 may be attached to lower housing portions 430 and 440. Tongue frame 510 may be fit over upper parts of lower housing portions 430 and 440. Specifically, contacting portions 454 may be inserted into slots 223 in nonconductive tongue insert portion 222 of tongue 220, though in other embodiments of the present invention, tongue insert portion 22 may be formed around contacting portions 454. Protrusions 912, 914, and 916 may fit in corresponding slots 1010 in tongue insert portion 222 of tongue 220. Folded ground contacts 920 and side ground loops 918 may engage with an inside surface of tongue frame 510.

In various embodiments of the present invention, protrusions 912, 914, 916 of central ground plane 910 may extend to various depths. In one example, the combined connector receptacle 100 may provide a number of USB type C connector receptacles. In this case, protrusions 912 and 916 may be located under high-speed differential pairs. These protrusions 912 and 916 may thus limit coupling between high-speed differential pair signals on the top and bottom sides of tongue 220. Protrusion 914 may be located under lower speed differential signals and may have a shallower depth. In various embodiments of the present invention, these protrusions 912, 914, and 916 may be used instead of a solid central tongue portion. A solid central tongue portion may require a corresponding slot in tongue insert portion 222 of tongue 220. Such a slot in tongue insert portion 222 may have an excessive width that may put tongue insert portion 222 at risk of collapse, thereby creating manufacturing problems. The use of separate protrusions may limit the lateral width of corresponding slots in the tongue insert portion 222 of tongue 220, thereby limiting the risk of collapse and simplifying the manufacturing process The use of protrusions 912, 914, 916, where central protrusion 914 is shorter, may also provide a centering effect during assembly and may make it easier to properly attach tongue frame 510 to lower housing portions 430 and 440.

In various embodiments of the present invention, molded portion 22 may be formed of a material that may be a VO grade plastic having a reduced glass fill content and having a high flow rate for better formation of the features such as slots 223 for contacting portions 454 and slots 1010 for protrusions 912, 914, and 916.

Figure 11:
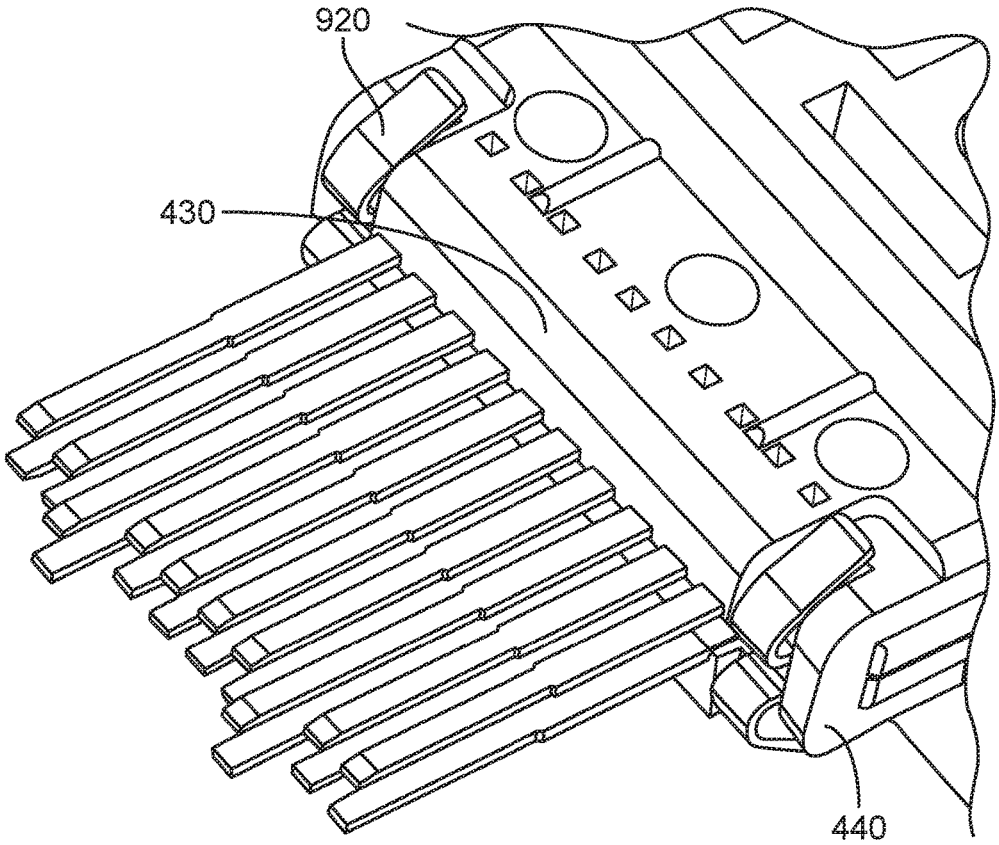
Figure 12:
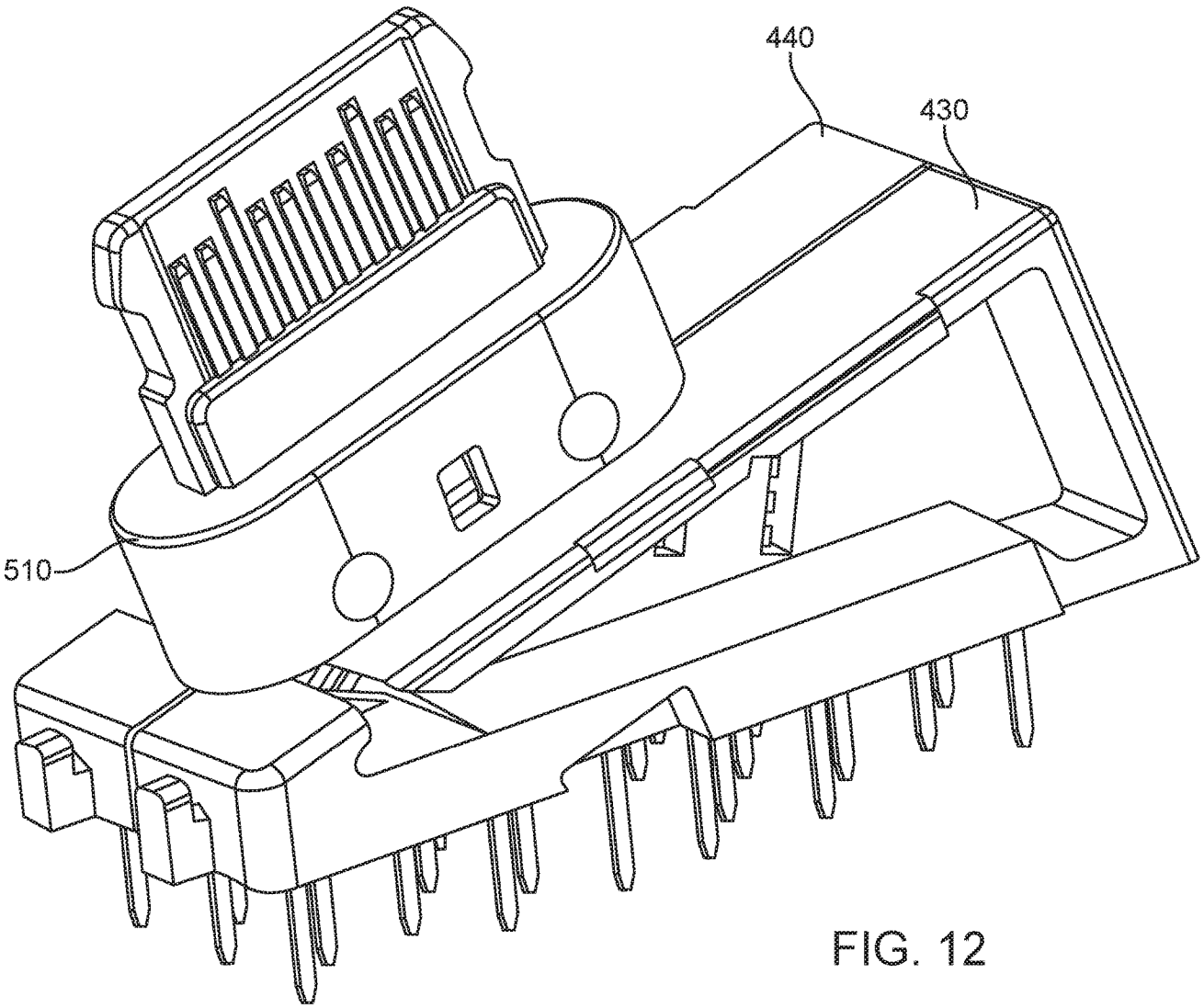

In FIG. 11, ground contact 920 may be folded over at tops of lower housing portions 430 and 440. In FIG. 12, tongue frame 510 may be attached to lower housing portions 430 and 440.

In various embodiments of the present invention, combined connector receptacles 100 may convey very high-speed signals. To improve signal quality at high-frequencies, embodiments of the present invention may provide differential signal paths having well-matched impedances between the two signal lines, as well as a high impedance for each signal line. Examples of this are shown in the following figures.

Figure 13:
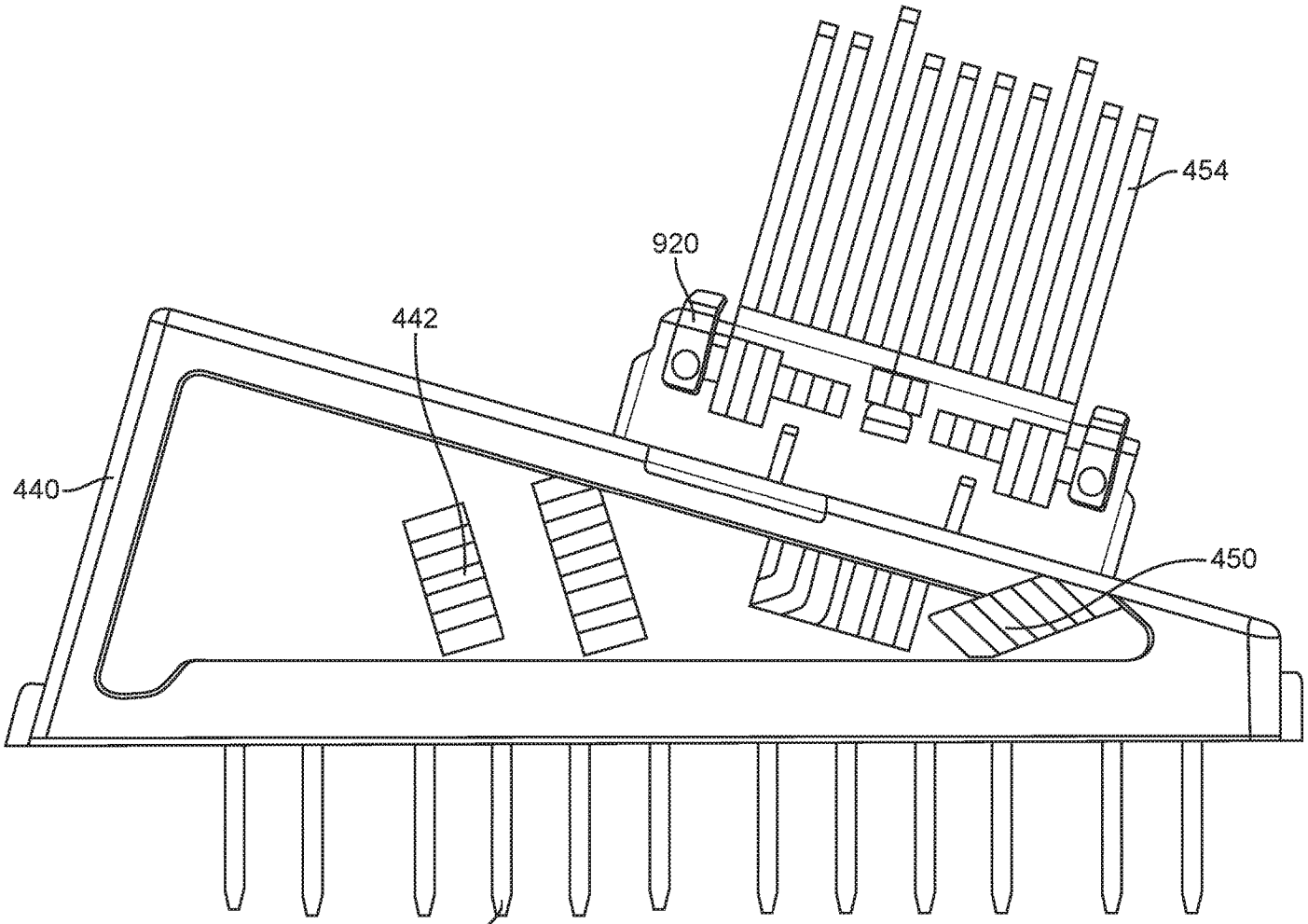
FIG. 13 illustrates a lower housing portion according to an embodiment of the present invention.

FIG. 13 illustrates a lower housing portion according to an embodiment of the present invention. In this example, lower housing portion 440 may be insert molded around portions of a number of contacts 450. Contacts 450 may have contacting portions 454 and through-hole contacting portions 452. Ground contacts 920 may be folded over at a top of housing portion 440. Lower housing portion 440 may include windows 442. Windows 442 may reduce an overall capacitance of contacts 450. This may in turn increase the impedance at frequency that is seen by contacts 450.

Figure 14:
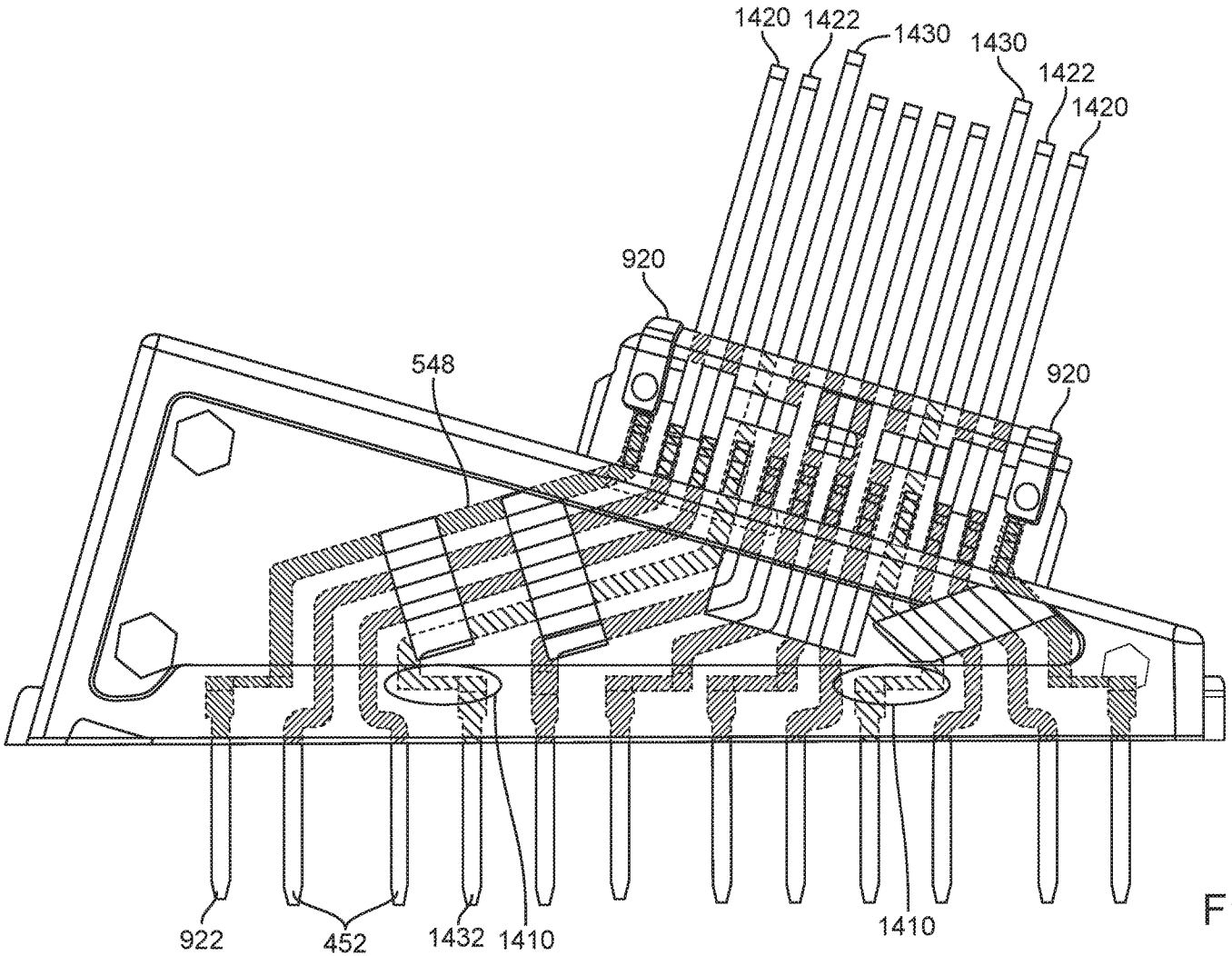
FIG. 14 illustrates details of a plurality of contacts for a lower housing portion according to an embodiment of the present invention.

FIG. 14 illustrates details of a plurality of contacts for a lower housing portion according to an embodiment of the present invention. In various embodiments of the present invention, these contacts may be stamped from a single piece of metal, such as stainless steel, sheet metal, or other type of conductive material. In other embodiments the present invention, these contacts may be printed or formed using other techniques. Contacts 1420 and 1422 may be used to convey high-speed differential signals. Contacts 1420 and 1422 may have adjacent ground 920 and power contacts 1430. To improve high-speed performance and the signal quality (or signal integrity) of the differential signals conveyed on contacts 1420 and 1422, it may be desirable to match the impedances on contacts 1420 and 1422 to each other. This matching may be improved by matching a length and spacing of adjacent contacts for ground 920 and power 1430.

A specific way this may be accomplished may be to route power contacts 1430 in such a way that acute angles 1410 are created in contacts 1430. While such an angle may create electromagnetic interference when conveying a signal contacts, since contacts 1430 convey power, the acute angle 1410 does not to create a signal quality issue. Ground contact 920 may terminate via through-hole portion 922, signal contacts 1420 and 1422 may terminate via through-hole contact portions 452, while power supply contact 1430 may terminate via a through-hole contact portion 1432. Additionally, a width of the contacts, for example mid-portions 548 may be made wider to adjust contact impedance. This arrangement may also lead to a reduced contact length, which may further reduce capacitance and increase contact impedance.

In various embodiments of the present invention, it may be desirable to stagger through-hole portions 922, 452, and 1432. This may allow more space for each through-hole contact, thereby simplifying printed circuit board manufacturing and allowing room for routing traces on the board. An example is shown in the following figure.

Figure 15:
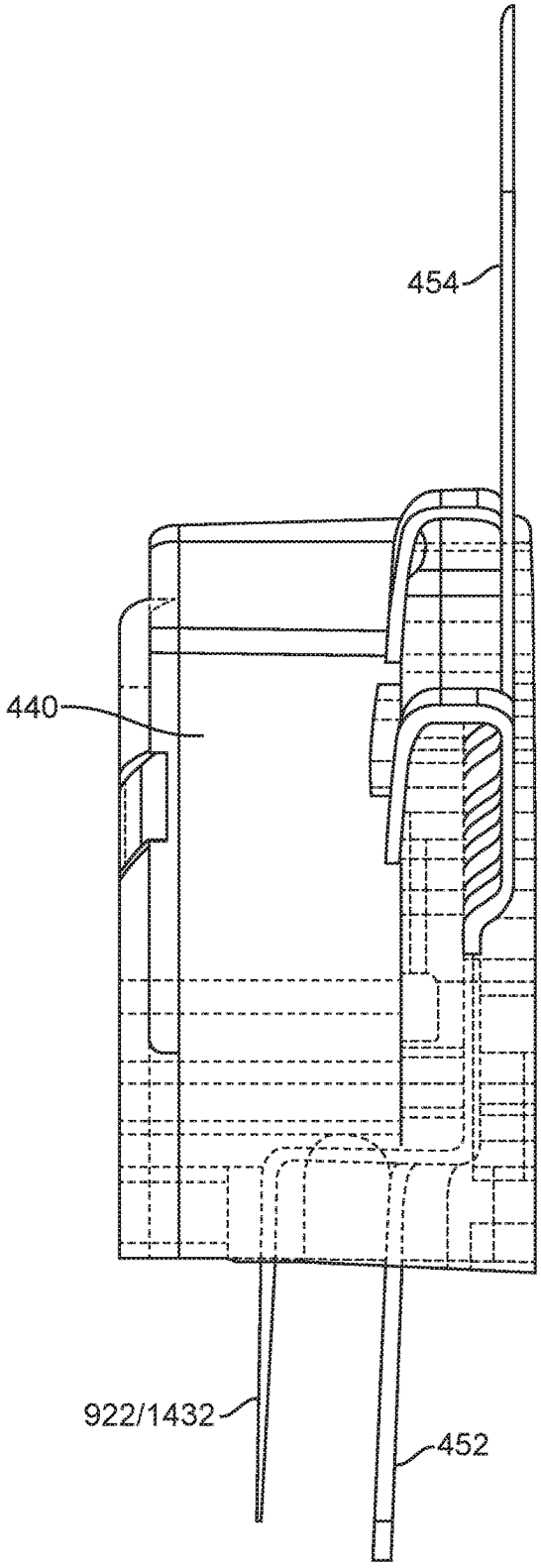
FIG. 15 illustrates a side view of a lower housing portion to an embodiment of the present invention.

FIG. 15 illustrates a side view of a lower housing portion to an embodiment of the present invention. Lower housing portion 440 may support a number of contacts having contacting portions 454 and through-hole contact portions 922, 1432, and 452. By staggering the power and ground through-hole portions 922 and 1432 by putting them in a different plane from signal through-hole contact portions 452, more space may be made available for each through-hole contacting portion. This additional space may simplify manufacturing of the printed circuit board and allow room for routing traces on the board.

In various embodiments of the present invention, various parts of contacts 450, such as through-hole contact portions 922, 1432, and 452, may be slightly non-orthogonal to one or more portions of contacts 450 or surfaces of lower housing portion 440. This may help to provide an angled combined connector receptacle 100 that may be aligned to a device enclosure that is oblique to a printed circuit board that supports the connector receptacle 100.

Figure 16:
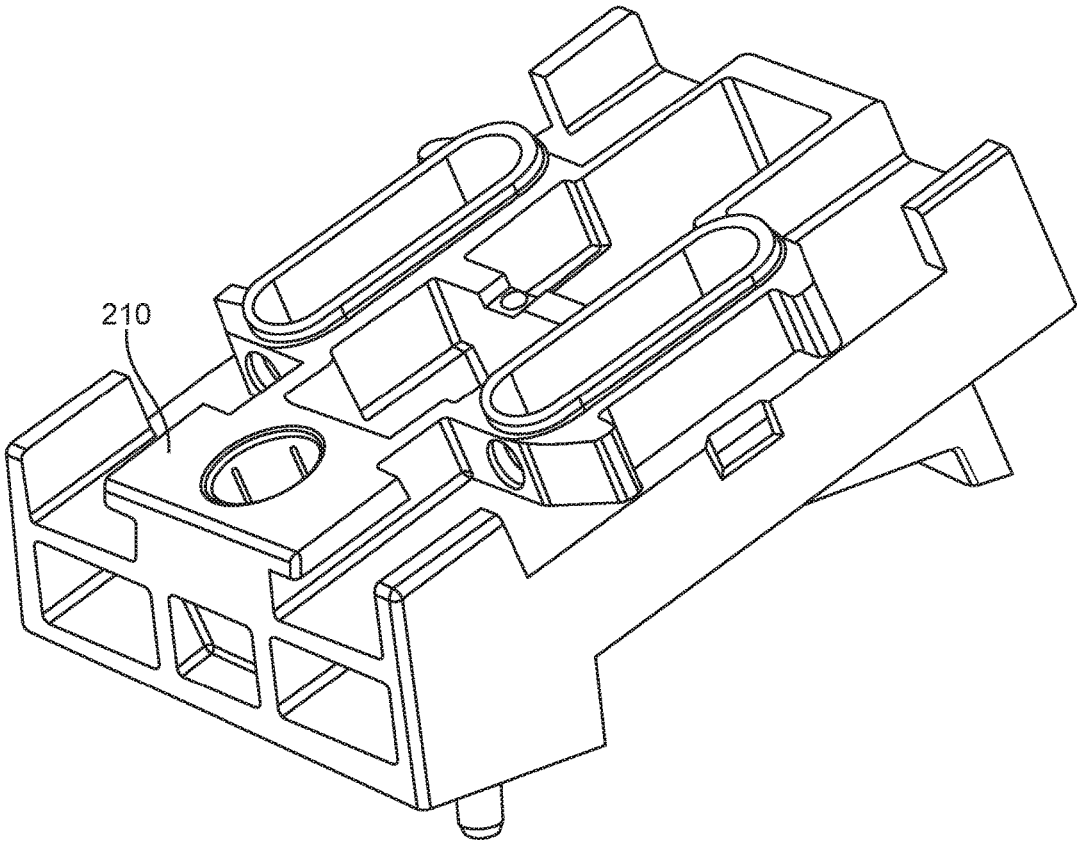
FIGS. 16-18 illustrate the assembly of a portion of a combined connector receptacle according to an embodiment of the present invention.
Figure 17:
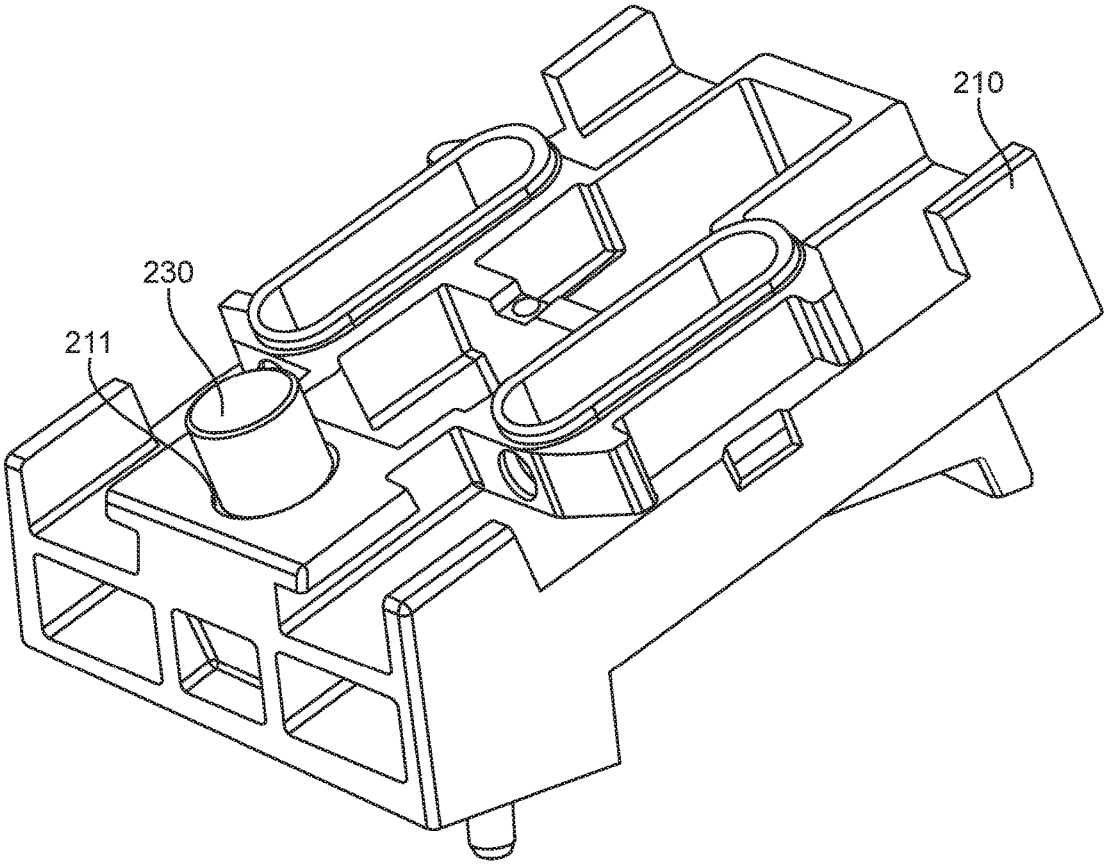

FIGS. 16-18 illustrate the assembly of a portion of a combined connector receptacle according to an embodiment of the present invention. In FIG. 16, upper housing 210 may be provided. In FIG. 17, alignment pin 230 may be inserted into opening 211 of upper housing 210. In FIG. 18, tabs 324 of EMI contacts 320 may be inserted into slots 214 in upper housing 210. EMI contacts 230 may include contacting portions 326 at its ends. In this example, alignment pin 230 is shown separately from the upper housing 210.

Figure 19:
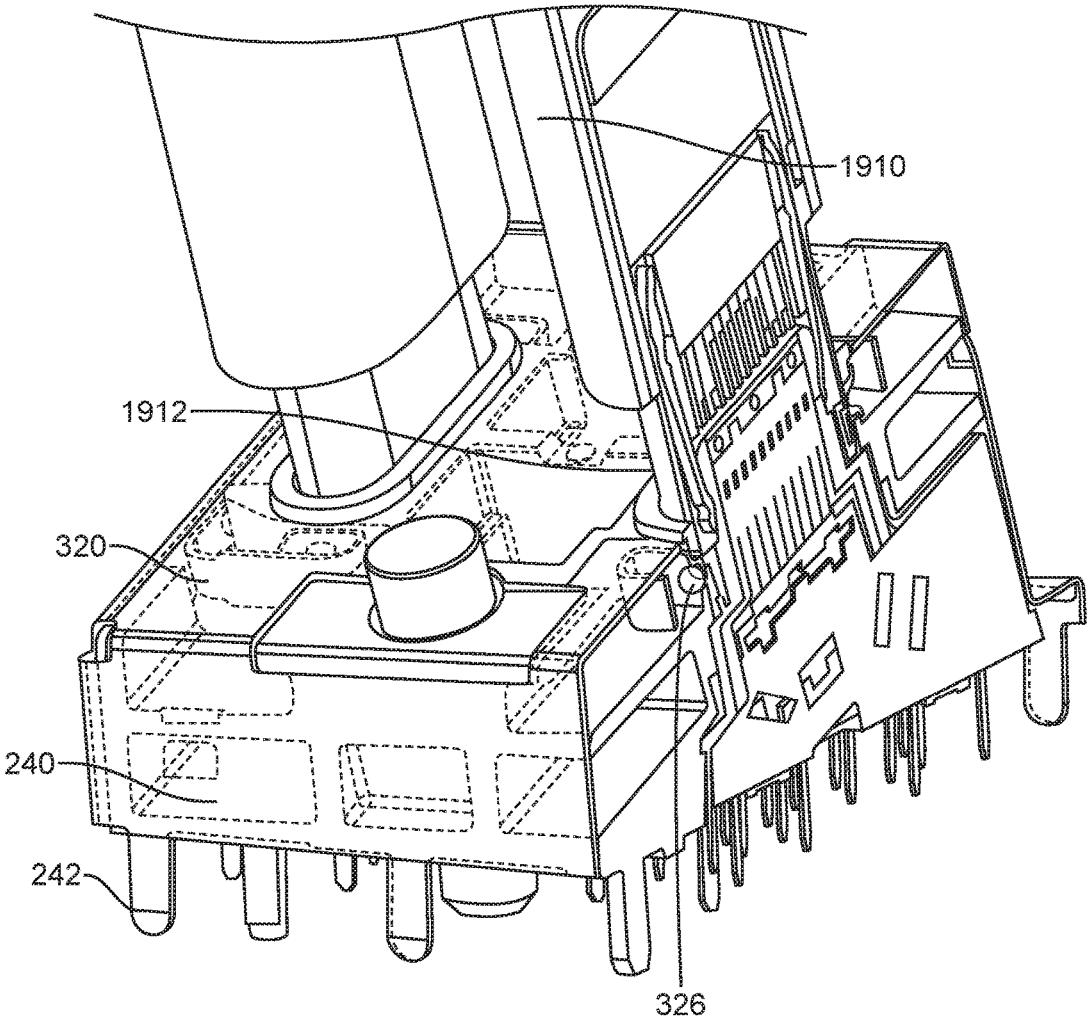
FIGS. 19-20 illustrate ground paths through a combined connector receptacle according to an embodiment of the present invention.
Figure 20:
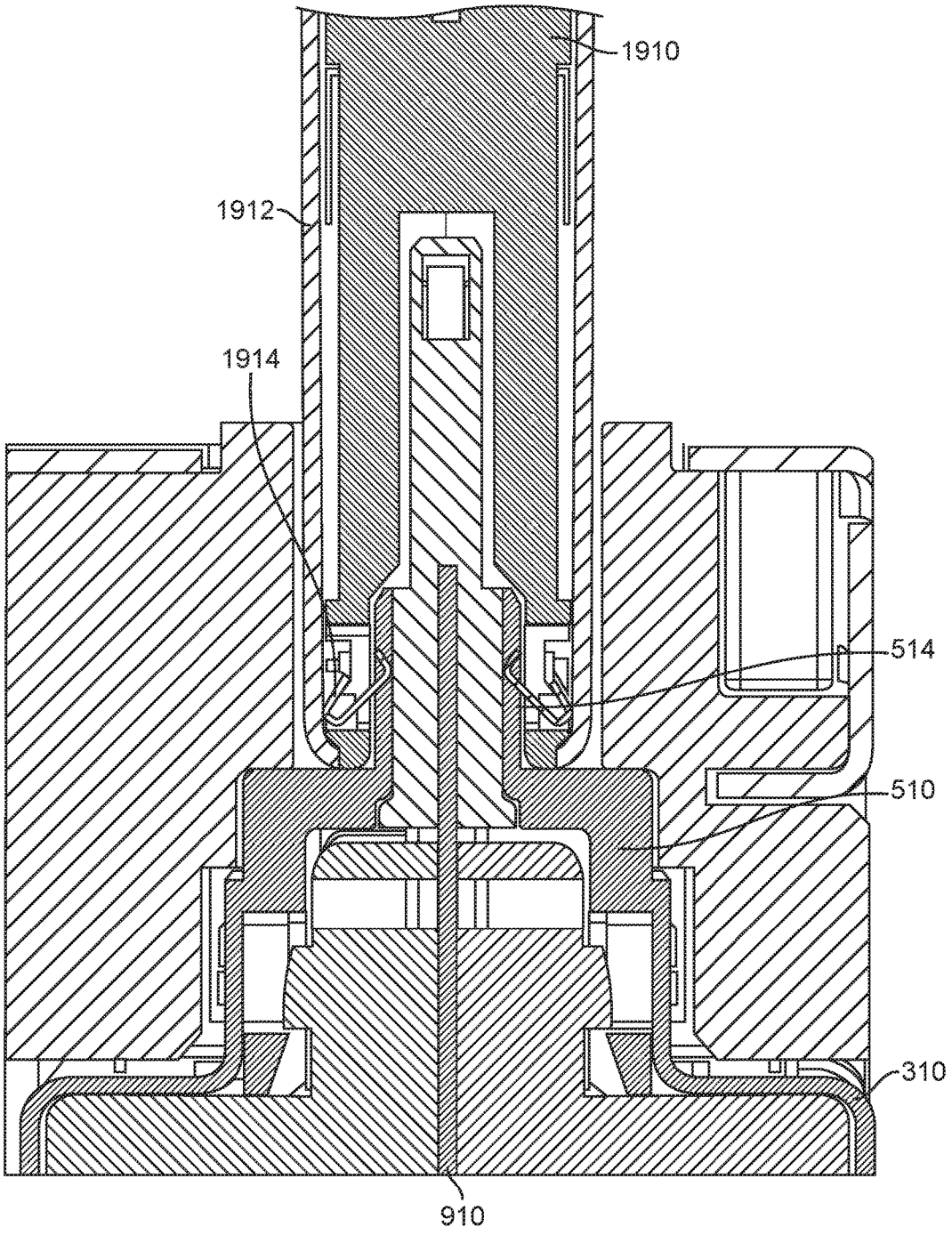

FIGS. 19-20 illustrate ground paths through a combined connector receptacle according to an embodiment of the present invention. In FIG. 19, a connector insert 1910 having a shield 1912 may be inserted into combined connector receptacle 100. Shield 1912 of connector insert 1910 may touch off against contacting portion 326 of EMI contact 320. EMI contacts 320 may be soldered or spot or laser welded to outer shield 240. Outer shield 240 may include tabs 242 that may provide connection to ground on a printed circuit board or other appropriate substrate (not shown.)

In FIG. 20, ground contacts 1914 of connector insert 1910 may be electrically connected to shield 1912 of connector insert 1910. Ground contacts 1914 of connector insert 910 may contact ground pads 514 of tongue frame 510. Tongue frame 510 may, as shown above, electrically connect to inner shield 310 and central ground plane 910. Central ground plane 910 may include contacts 919 as shown in FIG. 9 for making electrical connections to ground in a printed circuit board or other appropriate substrate. Inner shield 310 may electrically connect to outer shield 240 (not shown), which again may include tabs 242. Inner shield 310 may further include tabs 318 as shown in FIG. 5. Tabs 318 and 242 may be inserted into a printed circuit board or other appropriate substrate to form ground connections. An additional ground path through side ground contacts in connector insert 1910 may connect to side ground contacts 512 of tongue 210 as shown in FIG. 10. From there, ground may again return through inner shields 310 and central ground plane 910.

In various embodiments of the present invention, contacts, central ground planes, tongue frames, shields, EMI contacts, and other conductive portions of a combined connector receptacle may be formed by stamping, metal-injection molding, machining, micro-machining, 3-D printing, or other manufacturing process. The conductive portions may be formed of stainless steel, steel, copper, copper titanium, phosphor bronze, or other material or combination of materials. They may be plated or coated with nickel, gold, or other material. The nonconductive portions, such as the housings, tongue insert portions, and other structures may be formed using injection or other molding, 3-D printing, machining, or other manufacturing process. The nonconductive portions may be formed of silicon or silicone, rubber, hard rubber, plastic, nylon, liquid-crystal polymers (LCPs), ceramics, or other nonconductive material or combination of materials. The printed circuit boards used may be formed of FR-4 or other material. Printed circuit boards may be replaced by other substrates, such as flexible circuit boards, in many embodiments of the present invention.

Embodiments of the present invention may provide combined connector receptacles that may be located in, and may connect to, various types of devices, such as portable computing devices, tablet computers, desktop computers, laptops, all-in-one computers, wearable computing devices, cell phones, smart phones, media phones, storage devices, portable media players, navigation systems, monitors, power supplies, video delivery systems, adapters, remote control devices, chargers, and other devices. These combined connector receptacles may provide pathways for signals that are compliant with various standards such as one of the Universal Serial Bus (USB) standards including USB Type-C, High-Definition Multimedia Interface (HDMI), Digital Visual Interface (DVI), Ethernet, DisplayPort, Thunderbolt, Lightning, Joint Test Action Group (JTAG), test-access-port (TAP), Directed Automated Random Testing (DART), universal asynchronous receiver/transmitters (UARTs), clock signals, power signals, and other types of standard, non-standard, and proprietary interfaces and combinations thereof that have been developed, are being developed, or will be developed in the future. Other embodiments of the present invention may provide combined connector receptacles that may be used to provide a reduced set of functions for one or more of these standards. In various embodiments of the present invention, these interconnect paths provided by these connector inserts and connector receptacles may be used to convey power, ground, signals, test points, and other voltage, current, data, or other information.

The above description of embodiments of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications to thereby enable others skilled in the art to best utilize the invention in various embodiments and with various modifications as are suited to the particular use contemplated. Thus, it will be appreciated that the invention is intended to cover all modifications and equivalents within the scope of the following claims.

What is claimed is:

1. A combined connector receptacle comprising:

a first lower housing assembly comprising:

a first tongue;

a first plurality of contacts;

a second plurality of contacts;

a tongue insert portion to support contacting portions of the first plurality of contacts and the second plurality of contacts; and a central ground plane between the first plurality of contacts and the second plurality of contacts, wherein the central ground plane includes a plurality of protrusions extending into the first tongue;

a first inner shield over the first lower housing assembly;

a second lower housing assembly having a second tongue;

a second inner shield over the second lower housing assembly;

an upper housing over the first lower housing assembly and the second lower housing assembly, the upper housing having a first opening for the first tongue of the first lower housing assembly and a second opening for the second tongue of the second lower housing assembly; and a first outer shield over the upper housing, the first lower housing assembly, and the second lower housing assembly, wherein the first lower housing assembly further comprises:

a first housing portion around portions of the first plurality of contacts; and a second housing portion around portions of the second plurality of contacts, wherein the central ground plane is between the first housing portion and the second housing portion, and wherein the first housing portion and the second housing portion each comprise a plurality of windows to reduce capacitances of the first plurality of contacts and the second plurality of contacts.

2. The combined connector receptacle of claim 1, wherein the first lower housing assembly and the second lower housing assembly are the same.

3. The combined connector receptacle of claim 2, wherein the first inner shield and second inner shield are mirror images of each other.

4. The combined connector receptacle of claim 1, wherein the plurality of protrusions extending into the first tongue comprises three protrusions.

5. The combined connector receptacle of claim 1, wherein the first tongue comprises a tongue frame around a plastic molded portion forming the tongue insert portion.

6. The combined connector receptacle of claim 5, wherein the central ground plane includes two side loops to contact an inside surface of the tongue frame, and wherein the first plurality of contacts comprises a ground contact folded over near a top of the first housing portion to contact the inside surface of the tongue frame.

7. The combined connector receptacle of claim 1, wherein each of the first plurality of contacts comprise a through-hole contact portion.

8. The combined connector receptacle of claim 7, wherein the first plurality of contacts are stamped together from a single piece of metal.

9. The combined connector receptacle of claim 1, wherein the upper housing has a greater thickness above the first lower housing assembly than over the second lower housing assembly.

10. The combined connector receptacle of claim 1, wherein the first plurality of contacts comprises a plurality of signal contacts and a plurality of power contacts, wherein in a first plane, the plurality of power contacts each include an acute angle and the plurality of signal contacts do not include an acute angle.

11. The combined connector receptacle of claim 10, wherein the plurality of signal contacts comprises adjacent first and second signal contacts, the first and second signal contacts adjacent to a power contact and a ground contact, wherein the power contact includes the acute angle such that spacing between the ground contact and the first signal contact at least approximately matches the spacing between the power contact and the second signal contact.

12. The combined connector receptacle of claim further comprising an alignment pin in a passage through the upper housing and having a first end extending from a top of the upper housing and a second end extending from a bottom of the upper housing.

13. The combined connector receptacle of claim 1, wherein the first plurality of contacts includes a first pair of contacts for a first high-speed differential signal and a second pair of contacts for a second high-speed differential signal, and the second plurality of contacts includes a third pair of contacts for a third high-speed differential signal and a fourth pair of contacts for a fourth high-speed differential signal, wherein a first one of the plurality of protrusions is positioned between the first pair of contacts for the first high-speed differential signal and the third pair of contacts for the third high-speed differential signal and a second one of the plurality of protrusions is positioned between the second pair of contacts for the second high-speed differential signal and the fourth pair of contacts for the fourth high-speed differential signal.

14. A combined connector receptacle comprising:

a first lower housing assembly comprising:

a first tongue;

a first plurality of contacts including a first pair of contacts for a first high-speed differential signal and a second pair of contacts for a second high-speed differential signal;

a second plurality of contacts including a third pair of contacts for a third high-speed differential signal and a fourth pair of contacts for a fourth high-speed differential signal;

a tongue insert portion to support contacting portions of the first plurality of contacts and the second plurality of contacts; and a central ground plane between the first plurality of contacts and the second plurality of contacts, wherein the central ground plane includes a plurality of protrusions extending into the first tongue, wherein a first one of the plurality of protrusions is positioned between the first pair of contacts for the first high-speed differential signal and the third pair of contacts for the third high-speed differential signal and a second one of the plurality of protrusions is positioned between the second pair of contacts for the second high-speed differential signal and the fourth pair of contacts for the fourth high-speed differential signal;

a second lower housing assembly having a second tongue;

an upper housing over the first lower housing assembly and the second lower housing assembly, the upper housing having a first opening for the first tongue of the first lower housing assembly and a second opening for the second tongue of the second lower housing assembly;

a first inner shield over the first lower housing assembly;

a second inner shield over the second lower housing assembly; and a first outer shield over the upper housing, the first lower housing assembly, and the second lower housing assembly, wherein the upper housing has a first average thickness over the first lower housing assembly and a second average thickness over the second lower housing assembly, the first average thickness greater than the second average thickness.

15. The combined connector receptacle of claim 14, wherein the first lower housing assembly comprises a first plurality of contacts, and wherein the first plurality of contacts comprises a plurality of signal contacts and a plurality of power contacts, wherein in a first plane, the plurality of power contacts each include an acute angle and the plurality of signal contacts do not include an acute angle.

16. The combined connector receptacle of claim 14, wherein the plurality of protrusions extending into the first tongue comprises three protrusions.

17. The combined connector receptacle of claim 14, wherein the first lower housing assembly further comprises:

a first housing portion around portions of the first plurality of contacts; and a second housing portion around portions of the second plurality of contacts, wherein the central ground plane is between the first housing portion and the second housing portion, and wherein the first housing portion and the second housing portion each comprise a plurality of windows to reduce capacitances of the first plurality of contacts and the second plurality of contacts.

18. A combined connector receptacle comprising:

a first lower housing assembly comprising:

a first tongue;

a first plurality of contacts;

a second plurality of contacts;

a tongue insert portion to support contacting portions of the first plurality of contacts and the second plurality of contacts; and a central ground plane between the first plurality of contacts and the second plurality of contacts, wherein the central ground plane includes a plurality of protrusions extending into the first tongue;

a second lower housing assembly having a second tongue; and an upper housing over the first lower housing assembly and the second lower housing assembly, the upper housing having a first opening for the first tongue of the first lower housing assembly and a second opening for the second tongue of the second lower housing assembly;

a first inner shield over the first lower housing assembly;

a second inner shield over the second lower housing assembly; and a first outer shield over the upper housing, the first lower housing assembly, and the second lower housing assembly, wherein the first lower housing assembly comprises a first plurality of contacts, the first plurality of contacts comprising a plurality of signal contacts and a plurality of power contacts, wherein in a first plane, the plurality of power contacts each include an acute angle, wherein the first lower housing assembly further comprises:

a first housing portion around portions of the first plurality of contacts; and a second housing portion around portions of the second plurality of contacts, wherein the central ground plane is between the first housing portion and the second housing portion, and wherein the first housing portion and the second housing portion each comprise a plurality of windows to reduce capacitances of the first plurality of contacts and the second plurality of contacts.

19. The combined connector receptacle of claim 18, wherein the plurality of signal contacts do not include an acute angle, and wherein the plurality of signal contacts comprise adjacent first and second signal contacts, the first and second signal contacts adjacent to a power contact and a ground contact, wherein the power contact includes the acute angle such that spacing between the ground contact and the first signal contact at least approximately matches the spacing between the power contact and the second signal contact.

20. The combined connector receptacle of claim 18, wherein the plurality of protrusions extending into the first tongue comprises three protrusions.

21. The combined connector receptacle of claim 18, wherein the first plurality of contacts includes a first pair of contacts for a first high-speed differential signal and a second pair of contacts for a second high-speed differential signal, and the second plurality of contacts includes a third pair of contacts for a third high-speed differential signal and a fourth pair of contacts for a fourth high-speed differential signal, wherein a first one of the plurality of protrusions is positioned between the first pair of contacts for the first high-speed differential signal and the third pair of contacts for the third high-speed differential signal and a second one of the plurality of protrusions is positioned between the second pair of contacts for the second high-speed differential signal and the fourth pair of contacts for the fourth high-speed differential signal.

* * * * *